US010935899B2

(12) United States Patent
Shingu et al.

(10) Patent No.: US 10,935,899 B2
(45) Date of Patent: Mar. 2, 2021

(54) TUBULAR METAL BODY AND ELECTROPHOTOGRAPHIC PHOTORECEPTOR

(71) Applicant: FUJI XEROX CO., LTD., Tokyo (JP)

(72) Inventors: Kenta Shingu, Kanagawa (JP); Hiroaki Ogawa, Kanagawa (JP); Masaru Agatsuma, Kanagawa (JP); Yasuki Tanaka, Kanagawa (JP); Tsubasa Yamauchi, Kanagawa (JP); Akihiko Nakamura, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/520,497

(22) Filed: Jul. 24, 2019

(65) Prior Publication Data

US 2020/0310263 A1 Oct. 1, 2020

(30) Foreign Application Priority Data

Mar. 26, 2019 (JP) ..... JP2019-059408

(51) Int. Cl.
*G03G 5/10* (2006.01)
*G03G 5/05* (2006.01)

(52) U.S. Cl.
CPC ..... *G03G 5/102* (2013.01); *G03G 5/0542* (2013.01)

(58) Field of Classification Search
CPC ..... G03G 5/10; G03G 5/102
See application file for complete search history.

(56) References Cited

U.S. PATENT DOCUMENTS

2017/0261869 A1* 9/2017 Haruyama ..... B21C 1/26
2020/0081359 A1* 3/2020 Fujiwara ..... G03G 5/10

FOREIGN PATENT DOCUMENTS

JP 2008-132503 A 6/2008

* cited by examiner

*Primary Examiner* — Peter L Vajda
(74) *Attorney, Agent, or Firm* — Sughrue Mion, PLLC

(57) ABSTRACT

A tubular metal body includes a tubular part having an opening at one end in an axis direction; and a bottom part disposed at another end of the tubular part in the axis direction. The ratio (Rz1/Rz2) of a surface roughness Rz1 of an outer peripheral surface of the bottom part to a surface roughness Rz2 of an outer peripheral surface of a center portion of the tubular part in the axis direction is in a range of 2 or more and 4000 or less. A Vickers hardness HV1 of the outer peripheral surface of the bottom part is 5 HV or more and 27 HV or less smaller than a Vickers hardness HV2 of the outer peripheral surface of the center portion of the tubular part in the axis direction.

12 Claims, 14 Drawing Sheets

TUBULAR METAL BODY AND ELECTROPHOTOGRAPHIC PHOTORECEPTOR

CROSS-REFERENCE TO RELATED APPLICATIONS

This application is based on and claims priority under 35 USC 119 from Japanese Patent Application No. 2019-059408 filed Mar. 26, 2019.

BACKGROUND

(i) Technical Field

The present disclosure relates to a tubular metal body and an electrophotographic photoreceptor using the tubular metal body.

(ii) Related Art

One of the methods for mass-producing tubular metal bodies such as thin-walled metal containers at low cost known heretofore is an impact press method in which a tubular metal body is formed by applying an impact to a metal blank (slag) on a female mold (cavity plate) by using a male mold (punch).

For example, Japanese Unexamined Patent Application Publication No. 2008-132503 discloses "a method for manufacturing a bottomed container by loading a plastic material such as a slag into a cavity of a die and pressing the slag with a punch freely displaceable with respect to the die so as to plastically deform the plastic material into a bottomed container, the method including a first step of plastically deforming a plastic material into an intermediate container having a particular depth by using the die and the punch; a second step of heating the intermediate container obtained in the first step; a third step of washing the intermediate container heated in the second step; a fourth step of applying an oil to the intermediate container washed in the third step; a fifth step of drying the intermediate container having the oil applied thereto in the fourth step; and a sixth step of further plastic-deforming the intermediate container dried in the fifth step so as to form a container having a final depth".

SUMMARY

Aspects of non-limiting embodiments of the present disclosure relate to an impact-pressed tubular metal body that includes a tubular part having an opening at one end in an axis direction; and a bottom part disposed at another end of the tubular part in the axis direction in which generation of a region with a large surface roughness on the outer peripheral surface of the tubular part along the circumferential direction (this region is known as a shock line) specific to impact pressing is suppressed and thickness deviation is also suppressed compared to when the ratio (Rz1/Rz2) of a surface roughness Rz1 of an outer peripheral surface of the bottom part to a surface roughness Rz2 of an outer peripheral surface of a center portion of the tubular part in the axis direction is less than 2 or exceeds 4000, when a Vickers hardness HV1 of the outer peripheral surface of the bottom part is less than 5 HV or more than 27 HV smaller than a Vickers hardness HV2 of the outer peripheral surface of the center portion of the tubular part in the axis direction, or when an average crystal grain diameter D1 of the outer peripheral surface of the bottom part is less than 50 μm or more than 999.9 μm larger than an average crystal grain diameter D2 of the outer peripheral surface of the center portion of the tubular part in the axis direction.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a tubular metal body that includes a tubular part having an opening at one end in an axis direction; and a bottom part disposed at another end of the tubular part in the axis direction. The ratio (Rz1/Rz2) of a surface roughness Rz1 of an outer peripheral surface of the bottom part to a surface roughness Rz2 of an outer peripheral surface of a center portion of the tubular part in the axis direction is in a range of 2 or more and 4000 or less. A Vickers hardness HV1 of the outer peripheral surface of the bottom part is 5 HV or more and 27 HV or less smaller than a Vickers hardness HV2 of the outer peripheral surface of the center portion of the tubular part in the axis direction.

BRIEF DESCRIPTION OF THE DRAWINGS

Exemplary embodiments of the present disclosure will be described in detail based on the following figures, wherein.

DETAILED DESCRIPTION

Figure 1:
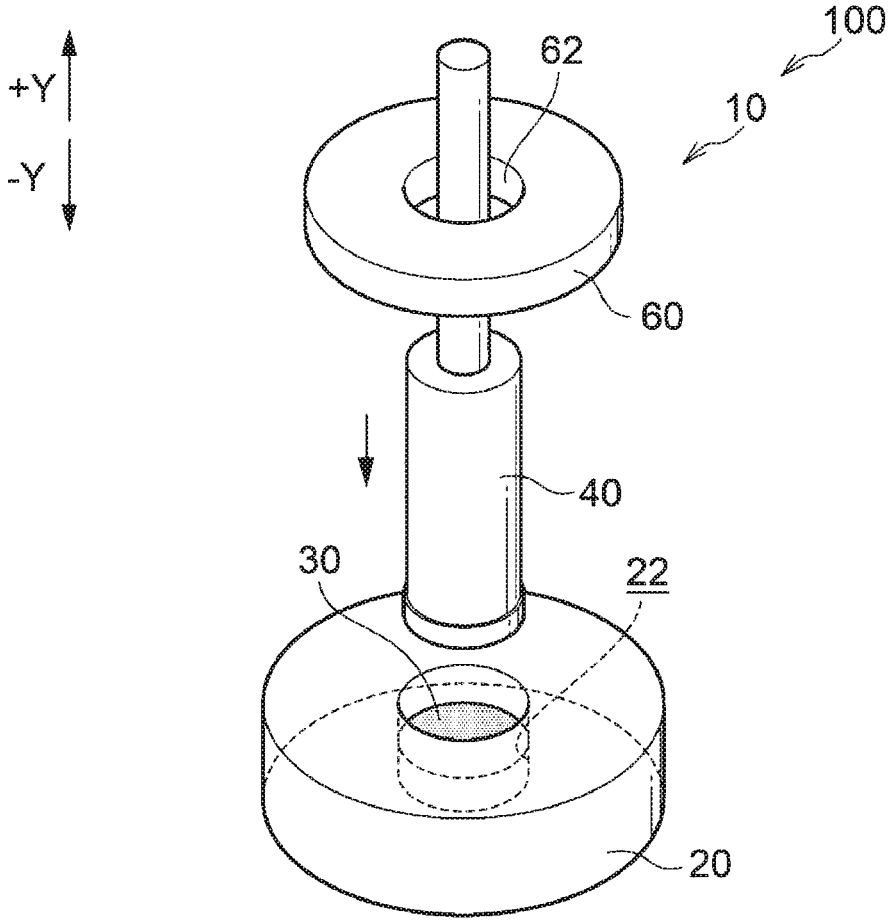
FIG. 1 is a perspective view illustrating the structure of an impact pressing device of a production apparatus according to an exemplary embodiment.

Exemplary embodiments, which are some of examples of the present disclosure, will now be described.

Impact-Pressed Tubular Metal Body

An impact-pressed tubular metal body according to an exemplary embodiment has a tubular part having an opening at one end in an axis direction; and a bottom part disposed at another end of the tubular part in the axis direction, and satisfies the condition (1) below and at least one of the conditions (2) and (3) below.

Condition (1): The ratio (Rz1/Rz2) of a surface roughness Rz1 of an outer peripheral surface of the bottom part to a surface roughness Rz2 of an outer peripheral surface of a center portion of the tubular part in the axis direction is in the range of 2 or more and 4000 or less.

Condition (2): A Vickers hardness HV1 of the outer peripheral surface of the bottom part is 5 HV or more and 27 HV or less smaller than a Vickers hardness HV2 of the outer peripheral surface of the center portion of the tubular part in the axis direction.

Condition (3): An average crystal grain diameter D1 of the outer peripheral surface of the bottom part is 50 μm or more and 999.9 μm or less larger than an average crystal grain diameter D2 of the outer peripheral surface of the center portion of the tubular part in the axis direction.

Here, impact pressing refers to a working method that involves pressing a slag (in other words, a metal blank) on a die (in other words, a female mold) with a punch (in other words, a male mold) so that the slag plastically deforms around the outer peripheral surface of the punch and forms a tubular metal body.

As described above, in impact pressing, a slag is pressed with a punch so that the slag plastically deforms around the outer peripheral surface of the punch and forms a tubular metal body. During this process, a punch-contacting-surface-side portion of the slag becomes elongated and plastically deformed while contacting the outer peripheral surface of the punch.

However, in impact pressing, a region with a large surface roughness may occur on the outer peripheral surface of the tubular part along the circumferential direction, and this region is called a shock line and is specific to impact pressing. A shock line is considered to occur due to unevenness of the shear stress during impact pressing, which causes crystal grains to appear and irregularities to occur on the outer peripheral surface of the tubular part.

Moreover, in impact pressing, control of the wall thickness evenness is inferior to that of cutting, and impact pressing is difficult to employ for usage that involves high shape accuracy. Specifically, for example, the wall thickness of a conductive substrate of a photoreceptor is desirably even, but thickness deviation may occur in such a usage.

The thickness deviation occurs presumably because unevenness of the material flow during impact pressing causes rupture at the flow interface between the materials and the material flow fluctuates during working and generates unevenness in wall thickness in the circumferential direction.

To address this issue, in the impact-pressed tubular metal body, the ratio (Rz1/Rz2) of the surface roughness Rz1 of the outer peripheral surface of the bottom part to a surface roughness Rz2 of the outer peripheral surface of the center portion of the tubular part in the axis direction is set within the range of 2 or more and 4000 or less.

In addition, a Vickers hardness HV1 of the outer peripheral surface of the bottom part is set to be 5 HV or more and 27 HV or less smaller than a Vickers hardness HV2 of the outer peripheral surface of the center portion of the tubular part in the axis direction, or an average crystal grain diameter D1 of the outer peripheral surface of the bottom part is set to be 50 μm or more and 999.9 μm or less larger than an average crystal grain diameter D2 of the outer peripheral surface of the center portion of the tubular part in the axis direction.

As such, by controlling the surface roughness Rz of the outer peripheral surface of the bottom part and the outer peripheral surface of the center portion of the tubular part in the axis direction, and at least one of the Vickers hardness HV1 and the average crystal grain diameter, the unevenness of the material flow during impact working is suppressed, and appearance of crystal grains is suppressed. In addition, rupture at the flow interface between the materials and fluctuation of the material flow during working are suppressed.

Thus, due to the aforementioned features of the impact-pressed tubular metal body of this exemplary embodiment, generation of a region with a large surface roughness (this region is called a shock line and is specific to impact pressing) in the outer peripheral surface of the bottom part side along the circumferential direction is suppressed, and so is thickness deviation.

Hereinafter, the impact-pressed tubular metal body (may also be referred to as the "tubular metal body" hereinafter) of the exemplary embodiment is described in detail. In the description below, the exemplary embodiment in which the condition (2) and the condition (3) are both satisfied is described; however, it is sufficient if one of these conditions is satisfied.

In the tubular metal body of this exemplary embodiment, the ratio (Rz1/Rz2) of the surface roughness Rz1 of the outer peripheral surface of the bottom part to the surface roughness Rz2 of the outer peripheral surface of the center portion of the tubular part in the axis direction is in the range of 2 or more and 4000 or less, and, from the viewpoint of suppressing generation of a shock line and thickness deviation, is preferably in the range of 2.75 or more and 3800 or less and more preferably in the range of 4 or more and 1200 or less.

From the viewpoint of suppressing generation of a shock line and thickness deviation, the surface roughness Rz1 of the outer peripheral surface of the bottom part is preferably 5 μm or more and 39.99 μm or less, more preferably 7 μm or more and 37.9 μm or less, and yet more preferably 9 μm or more and 35.7 μm or less larger than the surface roughness Rz2 of the outer peripheral surface of the center portion of the tubular part in the axis direction.

The surface roughness Rz2 of the outer peripheral surface of the center portion of the tubular part in the axis direction is preferably in the range of 0.01 μm or more and 5 μm or less and more preferably in the range of 0.1 μm or more and 4 μm or less.

In the tubular metal body of this exemplary embodiment, the Vickers hardness HV1 of the outer peripheral surface of the bottom part is 5 HV or more and 27 HV or less smaller and, from the viewpoint of suppressing generation of a shock line and thickness deviation, is preferably 5 HV or more and 18 HV smaller than the Vickers hardness HV2 of the outer peripheral surface of the center portion of the tubular part in the axis direction.

From the viewpoint of suppressing generation of a shock line and thickness deviation, the ratio (HV1/HV2) of the Vickers hardness HV1 of the outer peripheral surface of the bottom part to the Vickers hardness HV2 of the outer peripheral surface of the center portion of the tubular part in the axis direction is preferably in the range of 18/45 or more and 25/30 or less (or 0.4 or more and 0.83 or less), is more preferably in the range of 0.45 or more and 0.75 or less, and is yet more preferably in the range of 0.475 or more and 0.72 or less.

The Vickers hardness HV2 of the outer peripheral surface of the center portion of the tubular part in the axis direction is preferably in the range of 30 HV or more and 45 HV or less and more preferably in the range of 32 HV or more and 40 HV or less.

In the tubular metal body of this exemplary embodiment, the average crystal grain diameter D1 of the outer peripheral surface of the bottom part is 50 μm or more and 999.9 μm larger than and, from the viewpoint of suppressing generation of a shock line and thickness deviation, is preferably 90 μm or more and 960 μm larger than the average crystal grain diameter D2 of the outer peripheral surface of the center portion of the tubular part in the axis direction.

From the viewpoint of suppressing generation of a shock line and thickness deviation, the ratio (D1/D2) of the average crystal grain diameter D1 of the outer peripheral surface of the bottom part to the average crystal grain diameter D2 of the outer peripheral surface of the center portion of the tubular part in the axis direction is preferably in the range of 2 or more and 10000 or less, more preferably in the range of 2.5 or more and 1600 or less, and yet more preferably in the range of 2.63 or more and 700 or less.

The average crystal grain diameter D2 of the outer peripheral surface of the center portion of the tubular part in the axis direction is preferably in the range of 0.1 μm or more and 50 μm or less and more preferably in the range of 1 μm or more and 38 μm or less.

The methods for measuring the surface roughness Rz, the Vickers hardness HV, and the average crystal grain diameter D will now be described.

First, the measurement positions are described.

Figure 11:
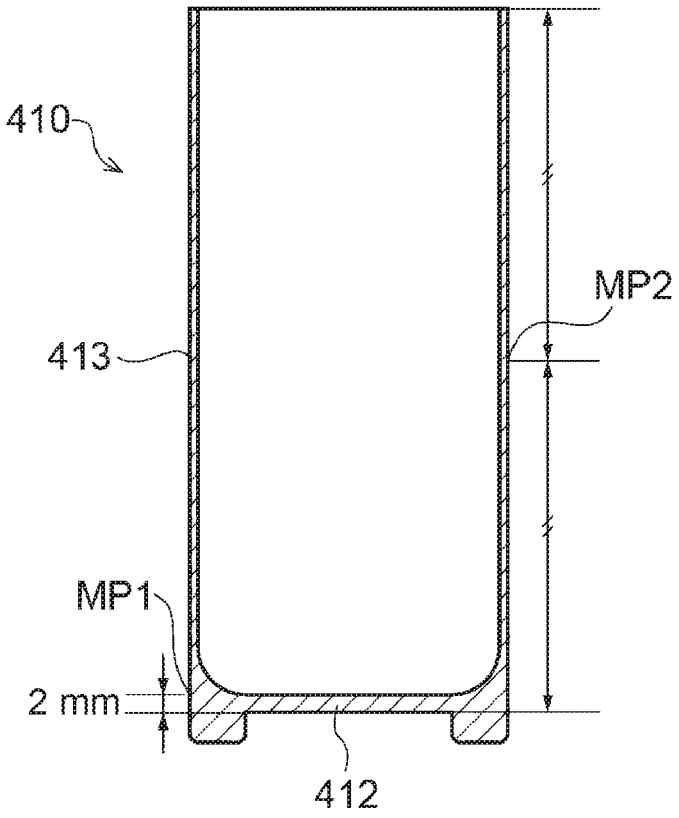
FIG. 11 is a schematic sectional view of one example of a tubular metal body according to an exemplary embodiment.

The measurement position on the "outer peripheral surface of the bottom part" is determined by drawing a phantom line extending orthogonal to the tubular part from the outer bottom surface center portion of the bottom part, and the position 2 mm from the intersection between the outer peripheral surface of the bottom part and the phantom line toward the opening of the tubular part is used as the measurement position (refer to FIG. 11).

The measurement position on the "outer peripheral surface of the tubular part" is the position on the outer peripheral surface of the tubular part at a height ½ of the height of the tubular metal body (refer to FIG. 11).

In FIG. 11, MP1 indicates the measurement position on the "outer peripheral surface of the bottom part", and MP2 indicates the measurement position on the "outer peripheral surface of the tubular part". In FIG. 11, 410 denotes the tubular metal body, 412 denotes the bottom part, and 413 denotes the tubular part.

Next, the method for measuring the surface roughness Rz is described.

The surface roughness Rz is the maximum height roughness according to JIS B 0601 (2013) and is measured by scanning the probe in the circumferential direction by 20 mm at the measurement position of the "outer peripheral surface of the bottom part" and the measurement position of the "outer peripheral surface of the tubular part". This operation is performed at three places, and the average value is employed as the surface roughness Rz of each measurement position.

The measurement conditions are evaluation length Ln=4.0 mm, sampling length L=0.8 mm, and cut-off value=0.8 mm.

Next, the method for measuring the Vickers hardness is described.

The Vickers hardness HV is measured at the measurement positions of the "outer peripheral surface of the bottom part" and the "outer peripheral surface of the tubular part" by using a Vickers hardness tester (trade name: MVK-HVL produced by Akashi Corporation) and by pressing an indenter thereat from the outer peripheral surface to measure the hardness at an indentation load of 1 kgf for an indentation time of 20 seconds. The places to be measured are four points equally spaced from one another in the circumferential direction and at each of the measurement positions of the "outer peripheral surface of the bottom part" and the "outer peripheral surface of the tubular part". The average value is employed as the Vickers hardness HV at each measurement position.

Next, the method for measuring the average crystal grain diameter D is described.

Samples that include the measurement positions of the "outer peripheral surface of the bottom part" and the "outer peripheral surface of the tubular part" are taken from the tubular metal body. The measurement position (in other words, the measurement surface) in each sample is mirror-finished by polishing with a polisher (Beta & Vector GRINDER-POLISHERS AND POWERHEAD produced by BUEHLER LTD.). Subsequently, by using a scanning electron microscope (JSM-7500F produced by JEOL Ltd.), the crystal grains at the measurement position are observed, and the crystal grain diameter is calculated.

Specifically, the crystal grain diameter is calculated by drawing a hypothetical line in an observation image and number-averaging the lengths of the crystals that traverse that line (measurement length: 1000 μm).

The places to be measured are four points equally spaced from one another in the circumferential direction and at each of the measurement positions of the "outer peripheral surface of the bottom part" and the "outer peripheral surface of the tubular part". The average value is employed as the average crystal grain diameter D at each measurement position.

In the tubular metal body of this exemplary embodiment, the aforementioned relationships regarding the surface roughness Rz, the Vickers hardness HV, and the average crystal grain diameter D between the outer peripheral surface of the bottom part and the outer peripheral surface of the center portion of the tubular part in the axis direction may also apply to the same relationships between the outer peripheral surface of the bottom part and the outer peripheral surface of a region in the outer peripheral surface of the tubular part, the region extending from the opening by a length equal to 70% or more and 90% or less (preferably 80% or more and 90% or less) of the axis-direction length of the tubular part.

The deviation of the thickness (in other words, the thickness deviation) of the tubular metal body (in particular, the tubular part thereof) of the exemplary embodiment is preferably 40 μm or less, more preferably 35 μm or less, and yet more preferably 30 μm or less. The lower limit of the thickness deviation may be 0, and is, for example, 5 μm or more from the viewpoint of productivity.

The thickness deviation is measured by the following method. By using an ultrasonic thickness meter, the thickness (wall thickness) is measured at 36 points equally spaced from one another in the circumferential direction from a particular point and from the opening side of the tubular part of the tubular metal body toward the bottom part side. Then the minimum thickness is subtracted from the maximum thickness. This operation is performed every 10 mm on 18 points in the axis direction of the tubular part of the tubular metal body. The maximum value is determined to be the thickness deviation.

The thickness (wall thickness) of the tubular metal body (specifically, the tubular part thereof) of the exemplary embodiment is not particularly limited and is determined according to the usage. For example, the thickness (wall thickness) of the tubular metal body (specifically, the tubular part thereof) is preferably 0.3 mm or more and 0.7 mm or less and more preferably 0.35 mm or more and 0.5 mm or less.

The thickness (wall thickness) of the tubular metal body (specifically, the tubular part thereof) is the average value of the thickness calculated for the thickness deviation.

The material of the tubular metal body of the exemplary embodiment is not particularly limited and is selected according to the usage.

For example, when the tubular metal body is used as a conductive substrate of a photoreceptor, the material of the tubular metal body may be aluminum or an aluminum alloy.

Examples of the aluminum alloy include those which contain, for example, Si, Fe, Cu, Mn, Mg, Cr, Zn, Ti, or the like in addition to aluminum. The aluminum alloy may be what is known as a 1000-series alloy.

The aluminum content (aluminum purity:mass ratio) is preferably 90.0% or more, more preferably 93.0% or more, and yet more preferably 95.0% or more from the viewpoint of workability.

The shape (specifically, the shape of the tubular metal body as viewed in the axis direction of the tubular metal body) of the tubular metal body of the exemplary embodiment is not particularly limited and is selected according to the usage. The shape of the tubular metal body may be circular, polygonal (rectangular or the like), or any of various other shapes.

Here, the tubular metal body of the exemplary embodiment is an impact-pressed tubular metal body prepared by impact pressing.

An impact-pressed tubular metal body typically exhibits high hardness (for example, 45 HV or more) due to work hardening. Thus, compared to a tubular metal body prepared by cutting a surface of an aluminum tubular tube (original tube) of the same type, the impact-pressed tubular metal body exhibits high hardness. Moreover, a thinner tubular metal body can be prepared by impact pressing.

The tubular metal body of the exemplary embodiment can be used as, for example, a conductive substrate for an electrophotographic photoreceptor. Alternatively, the tubular metal body can be used as a fuel cell casing or the like.

Method for Producing Tubular Metal Body According to Exemplary Embodiment

A method for producing a tubular metal body according to an exemplary embodiment employs impact pressing. One specific example is as follows.

First, one example of a production apparatus used in the method for producing a tubular metal body according to this exemplary embodiment (hereinafter this apparatus may be referred to as the "production apparatus of the exemplary embodiment") is described.

Production Apparatus 100

The features of a production apparatus 100 of the exemplary embodiment will now be described.

The production apparatus 100 illustrated in FIG. 1 etc., is one example of the production apparatus used to produce a tubular metal body. Specifically, the production apparatus 100 has a function of producing a circular tubular metal body 400 (refer to FIG. 10). In other words, the production apparatus 100 can be regarded as one example of the production apparatus for producing a conductive substrate of an electrophotographic photoreceptor.

The product that the production apparatus 100 produces is not limited to the circular tubular metal body 400 for an electrophotographic photoreceptor. For example, the production apparatus 100 may be an apparatus used for producing a circular tubular metal body used as a developing roll. The production apparatus 100 may be an apparatus used for producing a prism used as a battery case or the like.

Figure 8:
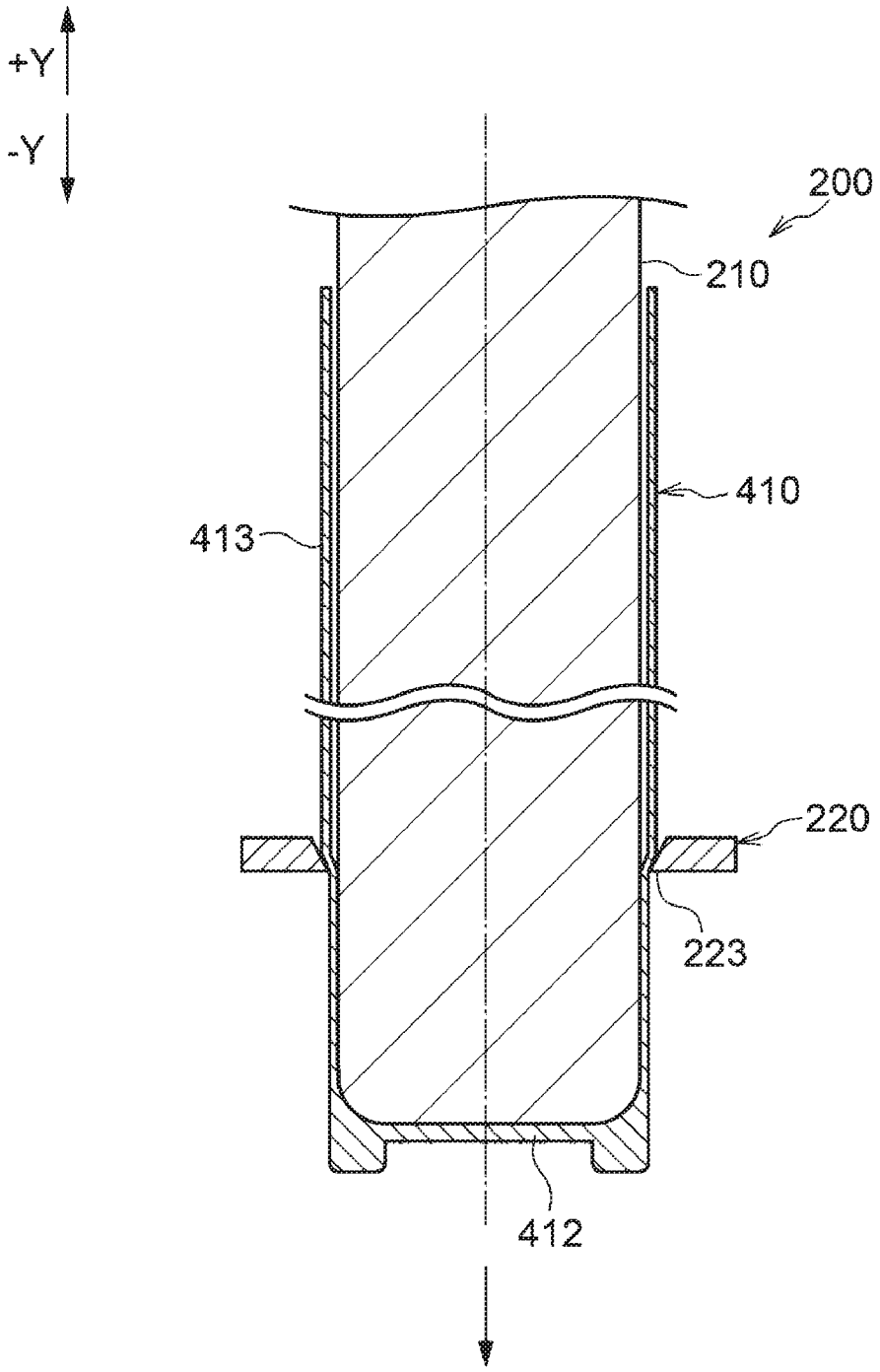
FIG. 8 is a side sectional view illustrating the structure of the ironing device according to an exemplary embodiment.
Figure 9:
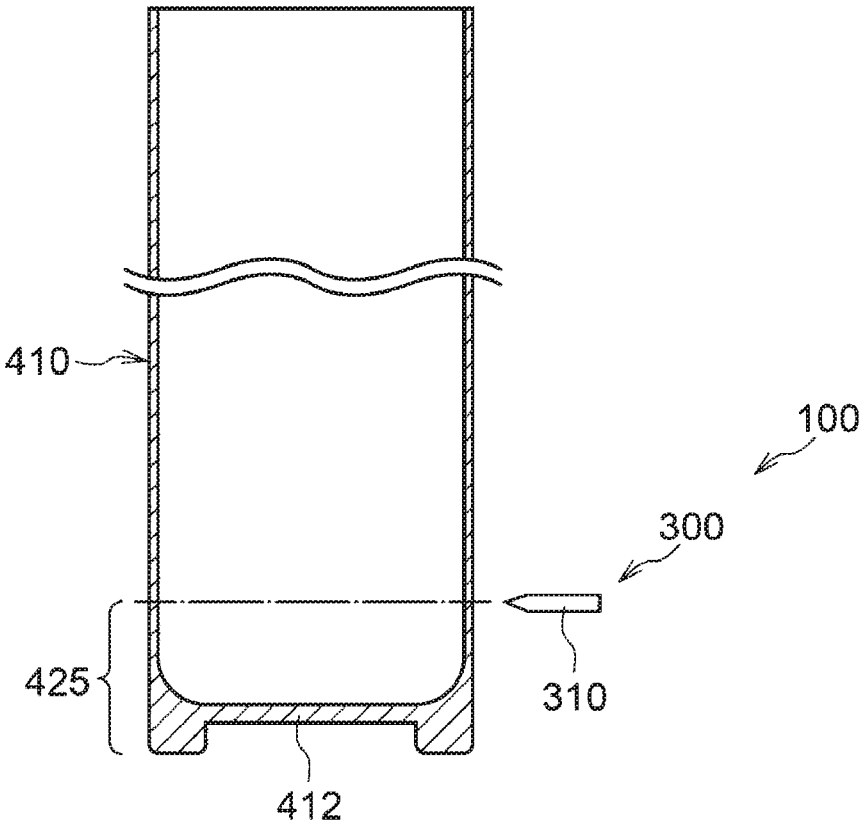
FIG. 9 is a schematic view illustrating the structure of a cutting device of the production apparatus according to the exemplary embodiment.
Figure 10:
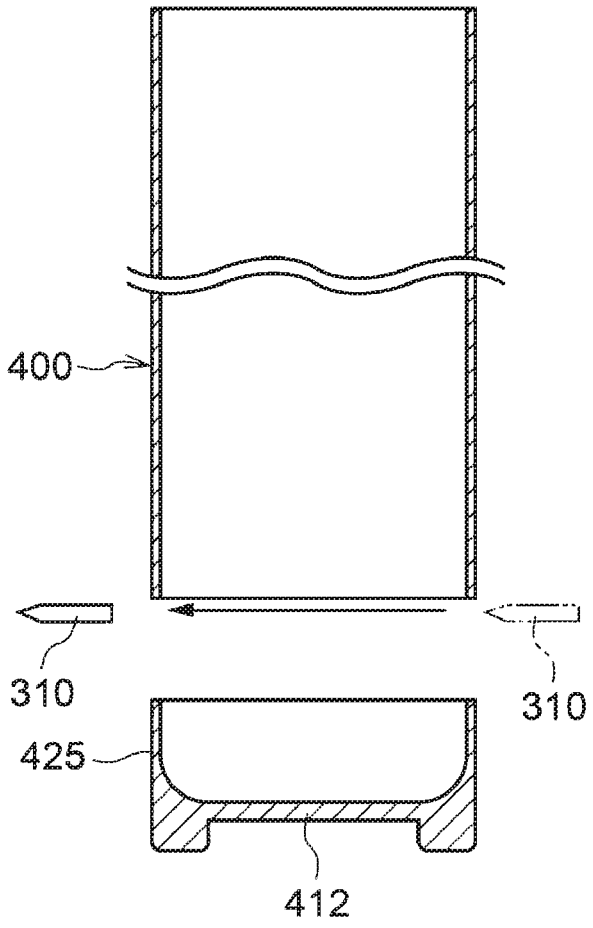
FIG. 10 is a schematic view illustrating a state in which a circular tubular metal body is cut by using the cutting device illustrated in FIG. 9.

Specifically, the production apparatus 100 includes an impact pressing device 10 (refer to FIGS. 1 and 2), an ironing device 200 (refer to FIGS. 7 and 8), and a cutting device 300 (refer to FIGS. 9 and 10). The impact pressing device 10, the ironing device 200, and the cutting device 300 are described below.

Impact Pressing Device 10

Figure 2:
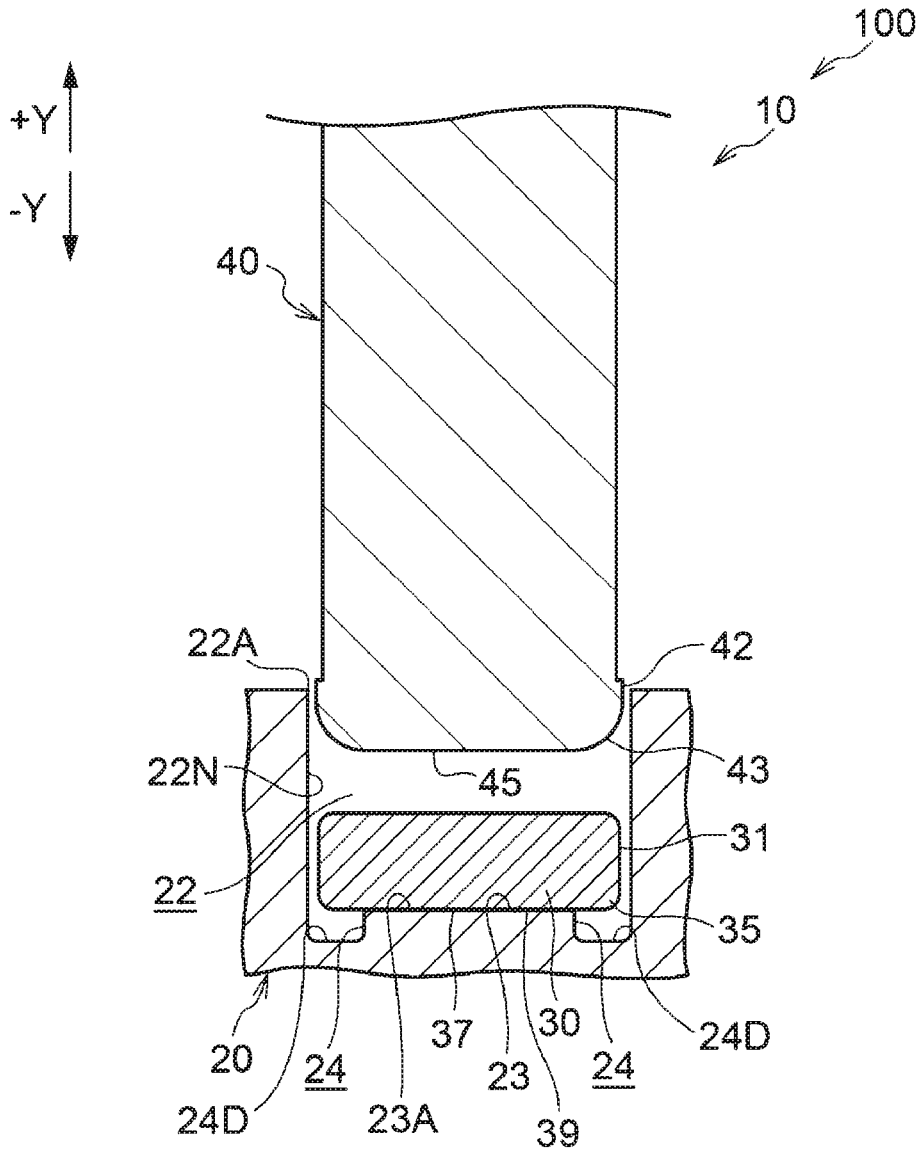
FIG. 2 is a side sectional view illustrating the structure of the impact pressing device according to an exemplary embodiment.

FIGS. 1 and 2 illustrate the structure of the impact pressing device 10. The impact pressing device 10 illustrated in FIGS. 1 and 2 is one example of an apparatus used for impact-pressing a metal blank, which is a raw material. Specifically, the impact pressing device 10 applies an impact to a slag 30, which is one example of the metal blank, so as to form a bottomed tubular body (in other words, a tubular metal body having a tubular part having an opening at one end in an axis direction, and a bottom part disposed at another end of the tubular part in the axis direction).

As one example, the impact pressing device 10 is arranged so that the arrow +Y direction side in the drawing is the vertically upward side and the arrow −Y direction side is the vertically downward side. Alternatively, the impact pressing device 10 may be arranged so that the +Y direction side is the horizontal direction side. The relationship between the direction in which the impact pressing device 10 is arranged and the direction of gravity is not relevant.

Specifically, as illustrated in FIG. 1, the impact pressing device 10 has a die 20, a punch 40, and a stripper 60. The slag 30 and respective components of the impact pressing device 10 (the die 20, the punch 40, and the stripper 60) are described below.

Slag 30

The slag 30 is one example of the metal blank. The material, shape, size, etc., of the slag 30 are selected according to the shape, size, usage, etc., of the formed product. When a support for an electrophotographic photoreceptor is to be produced as in this exemplary embodiment, a disk-shaped or column-shaped slag 30 composed of aluminum or an aluminum alloy may be used. Depending on the shape of the formed product, an elliptical column-shaped or prism-shaped slag 30 may be used, for example.

Examples of the aluminum alloy used as the slag 30 include those which contain, for example, Si, Fe, Cu, Mn, Mg, Cr, Zn, Ti, or the like in addition to aluminum. The aluminum alloy contained in the slag 30 used for producing a support for an electrophotographic photoreceptor may be what is known as a 1000-series alloy.

The method for preparing the slag 30 is not particularly limited. For example, when a column-shaped or a disk-shaped slag 30 is to be used, examples of the method include a method that involves cutting a rod-shaped metal material having a circular cross-section taken perpendicular to the longitudinal direction so that the cut piece has a length corresponding to the height (thickness) of the slag 30, and a method that involves punching out a circular piece from a metal plate having a thickness corresponding to the height (thickness) of the slag 30.

Die 20

The die 20 illustrated in FIGS. 1 and 2 is one example of a die having a cavity, on which a metal blank is to be placed, in the inner part, and a groove formed around the outer periphery of the bottom surface of the cavity. Specifically, as illustrated in FIG. 2, the die 20 is a female mold that has a cavity 22, on which the slag 30 is to be placed, in the inner part, and a groove 24 formed around the outer periphery of a bottom surface 23 of the cavity 22. More specifically, the die 20 has the following structure.

As illustrated in FIG. 1, the die 20 has, for example, a disk shape. The cavity 22 is formed in the center portion of the die 20 so as to form an opening in the upper surface (in FIG. 1, the surface on the +Y direction side) of the die 20. The cavity 22 has a column shape or a disk shape. In other words, the cavity 22 has a circular shape in plan (in FIG. 1, as viewed in the −Y direction).

As illustrated in FIG. 2, the bottom surface 23 of the cavity 22 is a flat surface facing upward (in FIG. 2, the +Y direction side). In other words the bottom surface 23 has no gradient (in other words, a flat surface). Alternatively, the bottom surface 23 may have a gradient, and, for example, may be a surface that protrudes upward (in FIG. 2, toward the +Y direction side) at a center in the radial direction.

The groove 24 is formed around the outer periphery of the bottom surface 23 of the cavity 22 so as to open upward at the bottom surface 23 (in FIG. 2, the +Y direction side). Specifically, the groove 24 has a ring shape in plan. That is, the groove 24 is formed in the bottom surface 23 so as to extend throughout the circumference along an inner peripheral surface 22N of the cavity 22. The outer periphery of the bottom surface 23 refers to a portion on the outer peripheral side (in FIG. 2, on the inner peripheral surface 22N side of the cavity 22) from the center of the bottom surface 23 in plan.

The groove 24 has a substantially rectangular shape in a side sectional view. The corners on the −Y direction side are rounded. A bottom surface 24D of the groove 24 is a flat surface facing upward (in FIG. 2, the +Y direction side). In other words, the bottom surface 24D has no gradient (in other words, a flat surface). Alternatively, the bottom surface 24D may have a gradient, and, for example, may be recessed downward (in FIG. 2, toward the −Y direction side) on the radially outer side of the cavity 22 (the bottom surface 23 thereof).

The groove 24 is formed so as to include the outer periphery of the bottom surface 23 and may be formed to also include a center portion of the bottom surface 23 in plan. Thus, the groove width (in other words, the dimension along the radial direction of the bottom surface 23) of the groove 24 may be larger than one half of the radius of the cavity 22.

Alternatively, an additional groove may be formed on the inner peripheral side of the groove 24. In other words, two or more grooves including the groove 24 may be formed in the bottom surface 23.

The groove 24 is a space that is recessed downward from an uppermost portion 23A of the bottom surface 23. The uppermost portion 23A is a portion on the most +Y direction side and is a portion close to an opening 22A (in FIG. 2, the end on the +Y direction side) in the cavity 22.

In this description, the "bottom" refers to a depth-side portion of the cavity 22 or the groove 24. As in this exemplary embodiment, when the impact pressing device 10 is arranged so that the arrow +Y direction side is the vertically upward side, the "bottom" is the "portion on the vertically downward side"; however, when the impact pressing device 10 is arranged so that the arrow +Y direction side is the horizontal direction side, the "bottom" is not the "portion on the vertically downward side". Specific functions of the groove 24 are described below.

Punch 40

Figure 3:
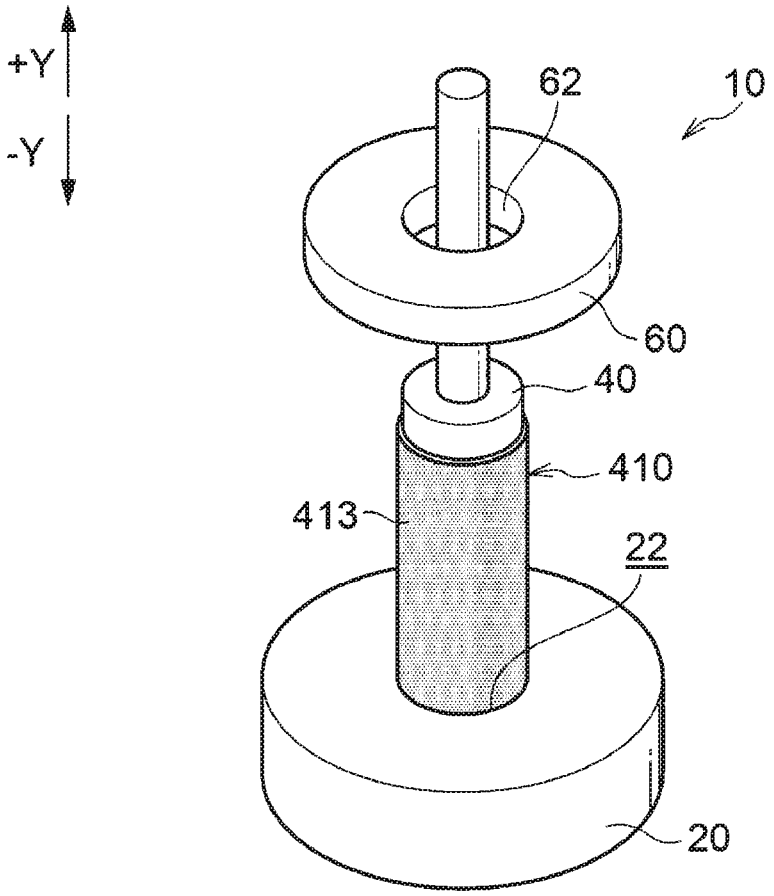
FIG. 3 is a perspective view illustrating a state in which a punch is inserted into a cavity of a die in the impact pressing device illustrated in FIG. 1.
Figure 4:
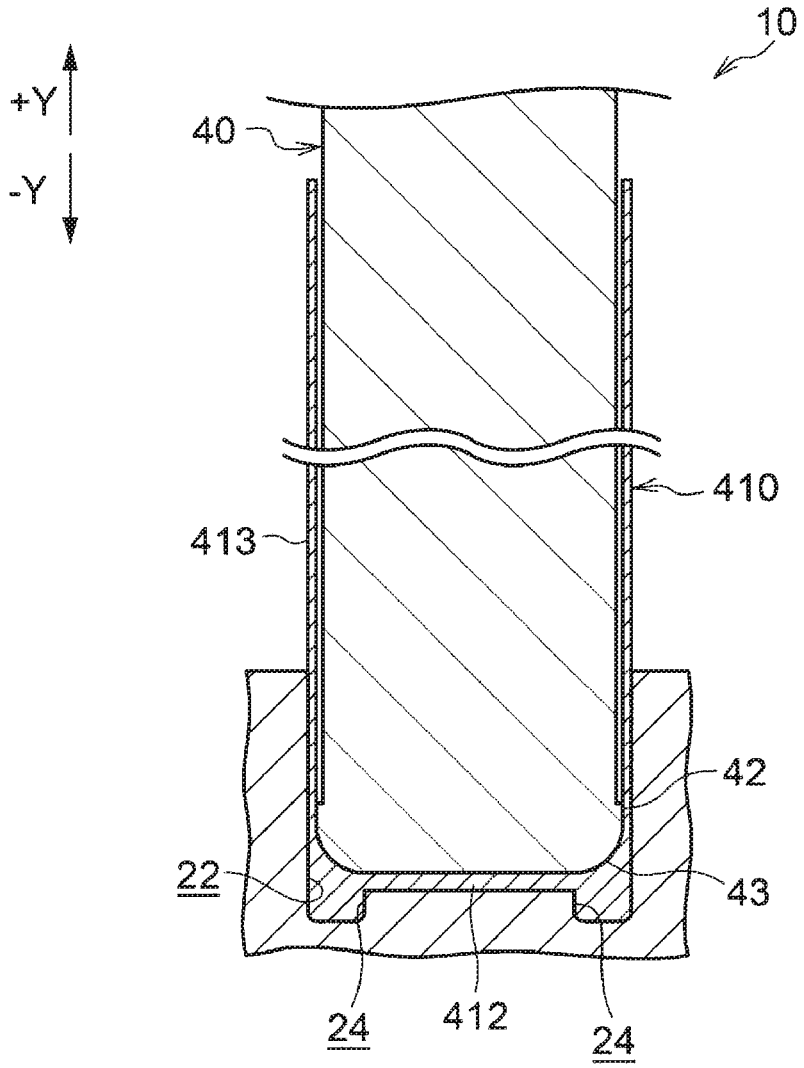
FIG. 4 is a side sectional view of the impact pressing device illustrated in FIG. 2.

The punch 40 illustrated in FIGS. 1 and 2 is one example of a punch that moves relative to the die and has a tip inserted into the cavity, and the shape thereof is not limiting. Specifically, as illustrated in FIGS. 3 and 4, the punch 40 is a male mold that descends toward the die 20 so that a tip 43 is inserted into the cavity 22. The punch 40 has a function of applying an impact to the slag 30 so as to press the slag 30. More specifically, the punch 40 has the following structure.

As illustrated in FIG. 1, the punch 40 has, for example, a column shape. In other words, the punch 40 has a circular shape in plan (specifically, in a sectional plan view). The outer diameter of the punch 40 is smaller than the inner diameter of the cavity 22 of the die 20. As illustrated in FIGS. 2 and 4, a large diameter portion 42 (or a land portion) having an outer diameter larger than that of a rear end side (in FIG. 2, on the +Y direction side) is formed on the tip side (in FIG. 2, the −Y direction side) of the punch 40. The large diameter portion 42 has a function of defining the inner diameter of a circular tubular metal body 410 (one example of a tubular body) to be formed. In other words, the outer peripheral surface of the large diameter portion 42 serves as a working surface that defines the inner diameter of the circular tubular metal body 410 to be formed. Note that the large diameter portion 42 is the portion having the largest diameter among the portions to be inserted into the cavity 22.

The tip 43 (in FIG. 2, the portion on the −Y direction side with respect to the large diameter portion 42) of the punch 40 is gradually tapered toward a tip surface 45 (in FIG. 2, the surface on the −Y direction side). The tip surface 45 is constituted by a flat surface facing the −Y direction side.

The punch 40 is configured to move up and down (in FIG. 2, the −Y direction and the +Y direction) when driving force is transmitted from a driving source not illustrated in the drawings.

As illustrated in FIGS. 3 and 4, the impact pressing device 10 squashes and deforms the slag 30 placed in the cavity 22 by applying an impact to the slag 30 by inserting the punch 40 into the cavity 22 containing the slag in such a manner that there is a clearance between the punch 40 and the bottom surface 23. In other words, the punch 40 presses the slag 30. As a result, the slag 30 becomes elongated from the cavity 22 so as to cover the perimeter (in other words, the outer periphery) of the punch 40 and form a circular tubular shape. Thus, a circular tubular metal body 410 having a bottom part 412 is formed.

Alternatively, the die 20 may move relative to the punch 40 so that the punch 40 is inserted into the cavity 22. In other words, the structure may be any as long as the punch 40 moves relative to the die 20. Furthermore, the shape of the punch 40 in plan (specifically, in a sectional plan view) and the shape of the cavity 22 in plan are selected according to the shape of the formed product. For example, when the formed product is a prism, the shape of the punch 40 in plan (specifically, in a sectional plan view) and the shape of the cavity 22 in plan are rectangular.

Stripper 60

Figure 5:
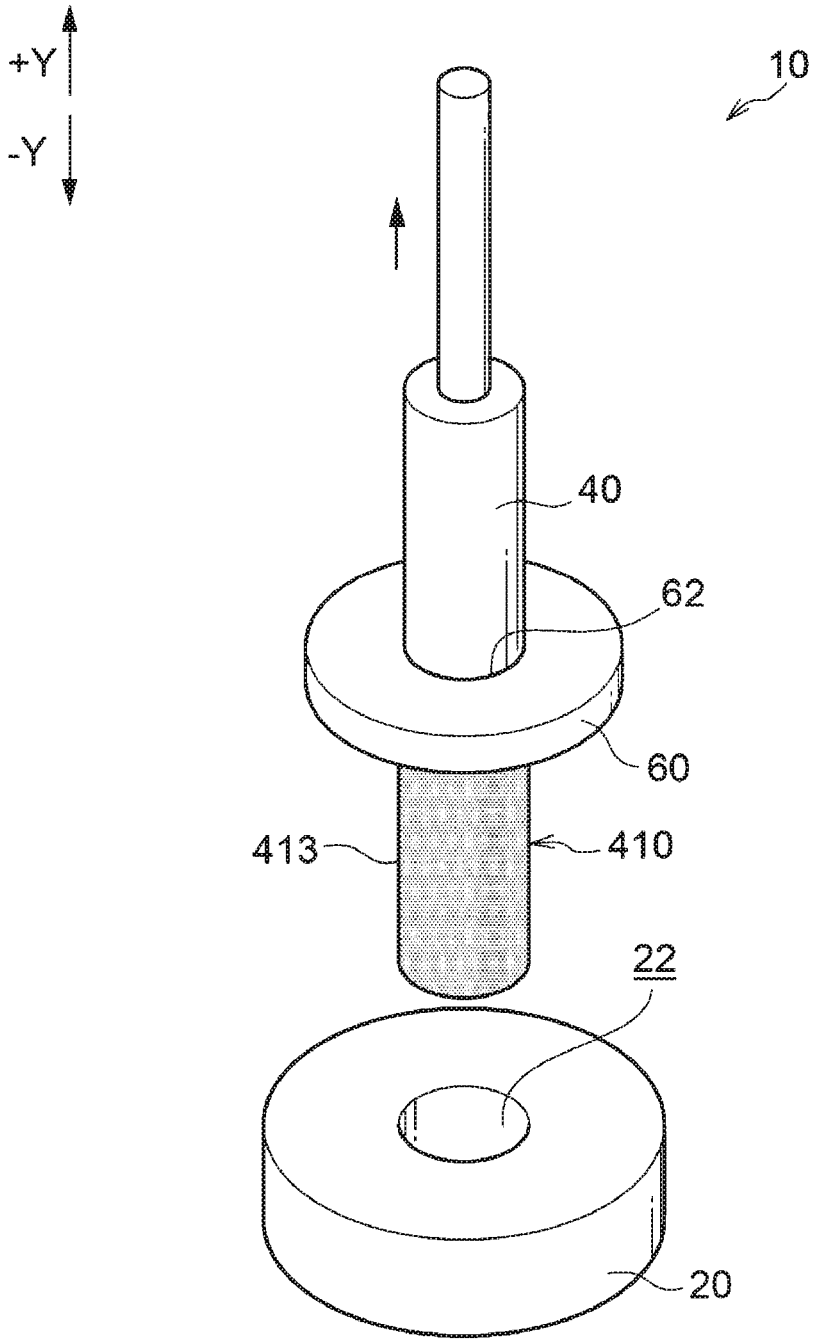
FIG. 5 is a perspective view illustrating the process of removing a formed circular tubular metal body from the punch in the impact pressing device illustrated in FIG. 1.

The stripper 60 illustrated in FIGS. 3 and 5 has a function of removing the formed circular tubular metal body 410 from the punch 40. The stripper 60 has a circular through hole 62 that penetrates through the center portion in plan. Thus, the stripper 60 is formed to have a ring shape in plan. As illustrated in FIG. 5, in the impact pressing device 10, the circular tubular metal body 410 is removed from the punch 40 by allowing the punch 40 to pass through the through hole 62 in the stripper 60 and by allowing the circular tubular metal body 410 to contact the stripper 60.

Dimensions of the Impact Pressing Device 10

Figure 6:
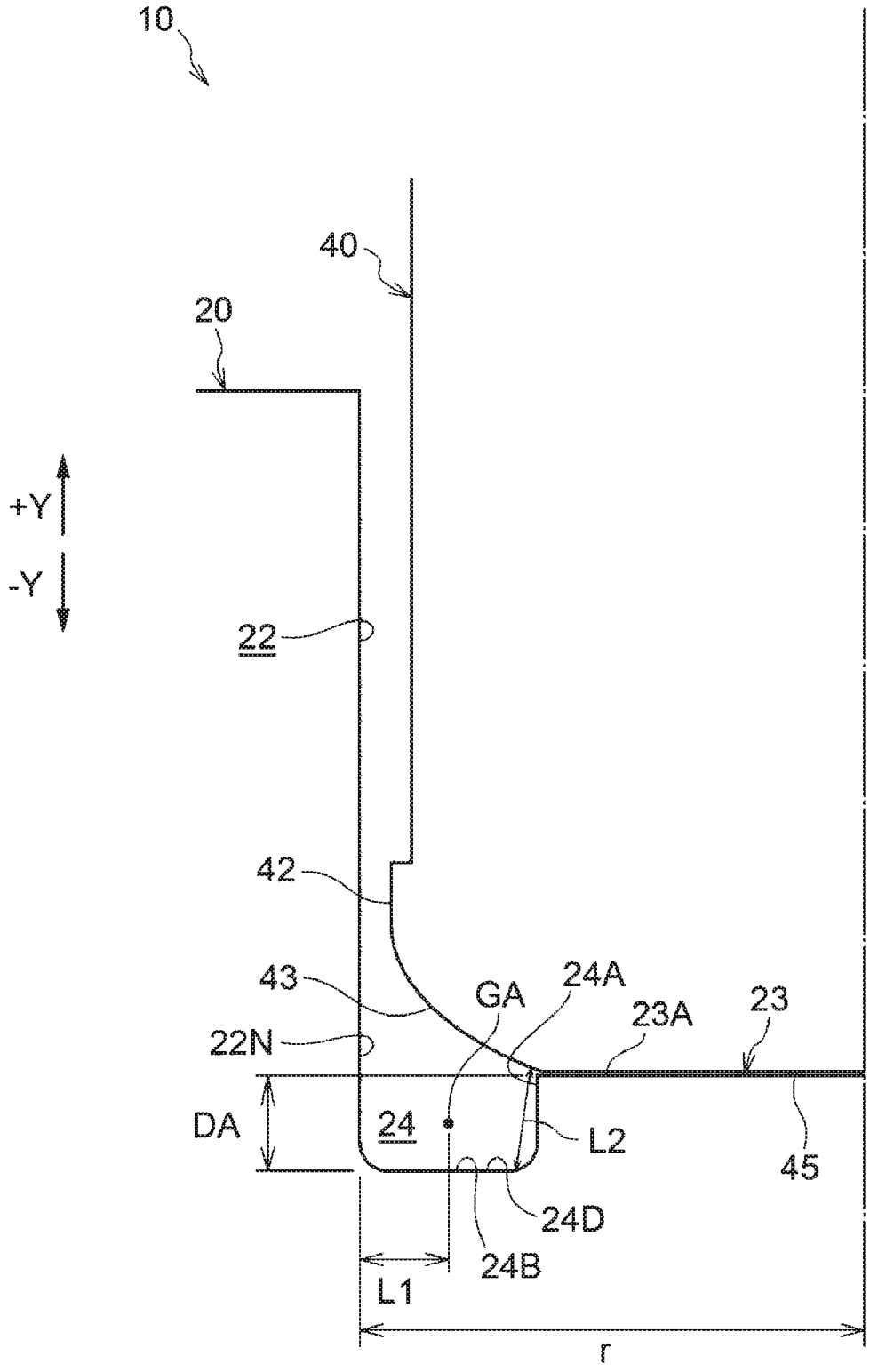
FIG. 6 is an enlarged side sectional view illustrating one portion of the punch and one portion of the die of the impact pressing device according to the exemplary embodiment.

When the radius of the cavity 22 of the die 20 is r, the maximum depth DA of the groove 24 is set to 0.05r (0.05×radius r) or more (refer to FIG. 6). The maximum depth DA of the groove 24 is, as illustrated in FIG. 6, a dimension from the uppermost portion 23A of the bottom surface 23 of the die 20 to a bottommost portion 24B of the groove 24, and is a dimension taken along the punch 40 insertion direction (in FIG. 6, the −Y direction).

The maximum depth DA of the groove 24 may be 0.08r or more from the viewpoint of the shock line suppressing effect. Moreover, the maximum depth DA of the groove 24 may be 0.1r or less from the viewpoint of material efficiency.

A first distance L1 between the center of gravity GA (refer to FIG. 6) of a section of the groove 24 and the inner peripheral surface 22N of the cavity 22 is set to 0.15r or less. The "section of the groove 24" refers to a section obtained by cutting the die 20 in the −Y direction. Specifically, the "section of the groove 24" refers to a section obtained by cutting the die 20 along the −Y direction so that the section passes through the center of the circular cavity 22 in plan. The "first distance L1 between the center of gravity GA of the section of the groove 24 and the inner peripheral surface 22N of the cavity 22" refers to the shortest distance from the center of gravity GA to the inner peripheral surface 22N of the cavity 22 in the aforementioned section.

A second distance L2 between the bottommost portion 24B of the groove 24 and the punch 40 when the punch 40 is allowed to contact the bottom surface 23 of the cavity 22 is set to be equal to or more than the maximum depth DA. Here, the "second distance L2 between the bottommost portion 24B of the groove 24 and the punch 40 when the punch 40 is allowed to contact the bottom surface 23 of the cavity 22" refers to the shortest distance from the bottommost portion 24B to the punch 40 in the aforementioned section.

When the impact pressing device 10 performs impact pressing, the punch 40 and the bottom surface 23 of the cavity 22 do not contact each other. In other words, impact pressing is performed by using the punch 40 in such a manner that there is a clearance between the punch 40 and the bottom surface 23 of the cavity 22. This clearance constitutes the bottom thickness of the formed product. Since the distance of the clearance is freely changed according to the desired bottom thickness, in this exemplary embodiment, the shortest distance between the bottommost portion 24B and the punch 40 when the punch 40 is allowed to contact the bottom surface 23 of the cavity 22 is for now set as the second distance L2. Since the second distance L2 is the shortest distance, the second distance L2 is not limited to the distance along the −Y direction.

Since the second distance L2 is equal to or more than the maximum depth DA, part of the punch 40 does not enter the cavity 22 when the punch 40 is allowed to contact the bottom surface 23 of the cavity 22. In other words, in this exemplary embodiment, when the punch 40 is allowed to contact the bottom surface 23 of the cavity 22, part of the punch 40 does not enter the cavity 22. In other words, in this exemplary embodiment, the punch 40 does not have a protruding part that enters the cavity 22 when the punch 40 is allowed to contact the bottom surface 23 of the cavity 22. In other words, in this exemplary embodiment, when the punch 40 is allowed to contact the bottom surface 23 of the cavity 22, a portion of the tip surface 45 of the punch 40 that opposes the groove 24 is above the opening 24A (in FIG. 6, the end on the +Y direction side) of the groove 24.

The groove width of the groove 24 is, for example 0.1r or more and 0.9r or less. The groove width of the groove 24 is the dimension along the radius direction of the cavity 22 at the opening 24A of the groove 24 in the aforementioned "section of the groove 24".

Function of Groove 24

As mentioned above, by setting the maximum depth DA, the first distance L1, and the second distance L2 of the groove 24 illustrated in FIG. 6, the groove 24 detains the slag 30 that has entered the groove 24 by being pressed with the punch 40. Specifically, the groove 24 detains a bottom-surface-23-side outer peripheral portion 35 of the slag 30 that has entered the groove 24 by being pressed with the punch 40.

Here, "detain" means that the amount of the movement of the slag 30 that has entered the groove 24 by being pressed with the punch 40 is smaller than the amount of the movement of the slag 30 in the structure that does not have the groove 24. Accordingly, as long as the amount of the movement is reduced, the structure may be arranged such that the slag 30 that has entered the groove 24 by being pressed with the punch 40 is discharged from the groove 24.

The "bottom-surface-23-side outer peripheral portion 35 of the slag 30" specifically refers to a corner portion (in other words, a border portion) between a bottom surface 39 (in FIG. 2, the surface on the −Y direction side) and a side surface 31 (in other words, a peripheral surface) of the slag 30. This corner portion is rounded.

In the exemplary embodiment, specifically, the groove 24 causes the outer peripheral portion 35 of the slag 30 to stay in a portion that constitutes an axis-direction end portion of the circular tubular metal body 410 to be formed. More specifically, the groove 24 causes the outer peripheral portion 35 of the slag to stay within the groove 24. In this exemplary embodiment, the "portion that constitutes an axis-direction end portion of the circular tubular metal body 410" is specifically an axis-direction end portion 425 (refer to FIGS. 9 and 10) to be cut by the cutting device 300. Alternatively, the "portion that constitutes an axis-direction end portion of the circular tubular metal body 410" may be understood as a portion close to the axis-direction end than the axis-direction center of the circular tubular metal body 410. Furthermore, "stay" means keeping the position. Thus, the phrase "causes the outer peripheral portion 35 of the slag 30 to stay within the groove 24" means that the outer peripheral portion 35 is positioned inside the groove 24.

In this exemplary embodiment, a bottom-surface-23-side center portion 37 of the slag 30 passes between the inner peripheral surface 22N of the cavity 22 and the outer peripheral surface of the punch 40 by being pressed with the punch 40. In other words, the center portion 37 of the slag 30 is moved to an axis-direction center-side portion of a tubular part 413 of the circular tubular metal body 410. The "axis-direction center-side portion" refers to the portion on the center side with respect to the axis-direction end portion 425. Specifically, the axis-direction center-side portion is the portion used as the product.

The maximum depth DA, the first distance L1, and the second distance L2 of the groove 24 are not limited to the figures described above. As long as the groove 24 exhibits the detaining function, the maximum depth DA, the first distance L1, and the second distance L2 of the groove 24 may be set in numerical ranges different from those described above.

When a part of the slag 30 (for example, the outer peripheral portion 35 or the center portion 37) is marked (colored) and then impact pressing is performed, the amount of movement of that part can be determined by checking the colored position in the formed product. By using this method, whether that part of the slag 30 is detained or not and where that part of the slag 30 stays can be identified.

Ironing Device 200

Figure 7:
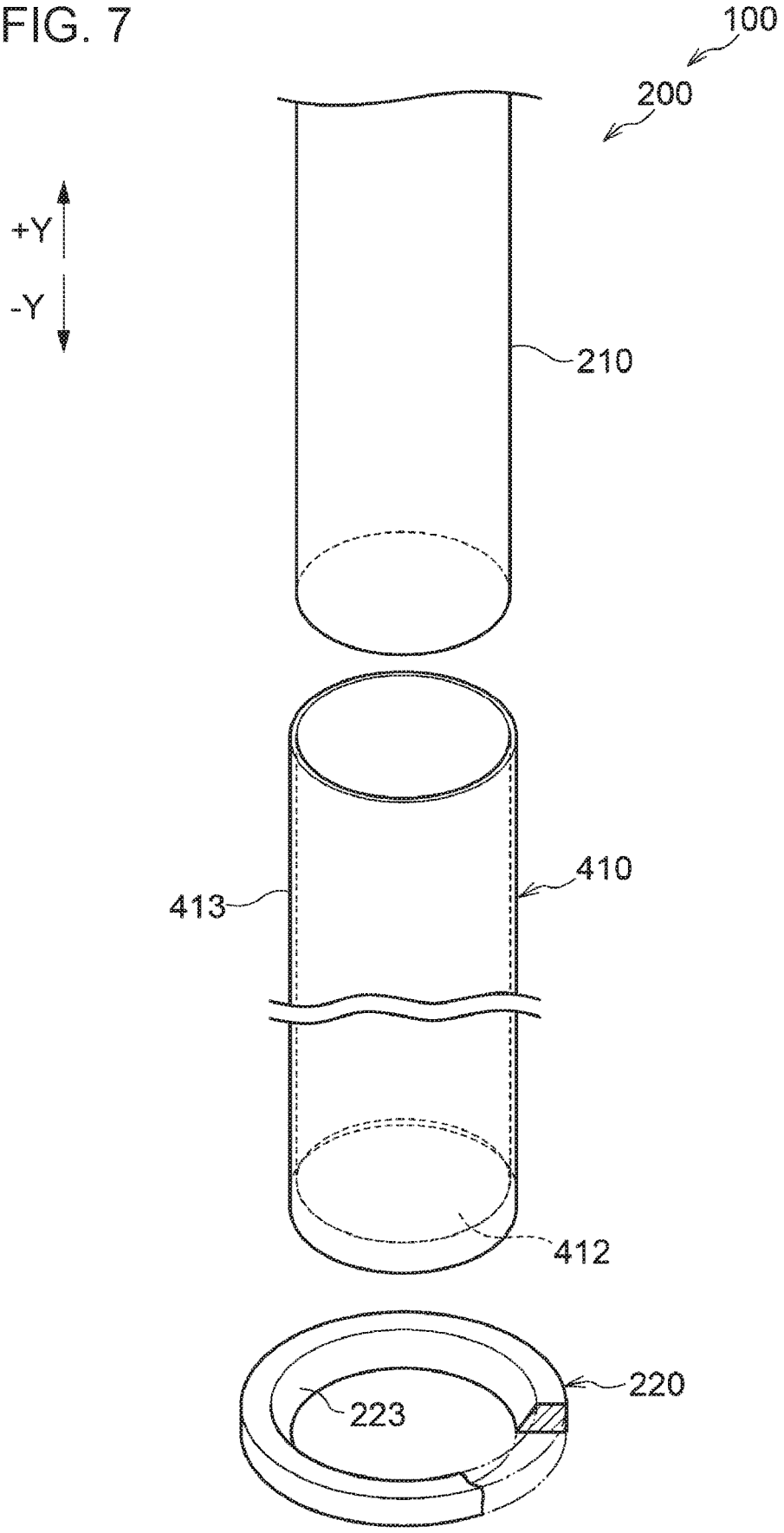
FIG. 7 is a perspective view illustrating the structure of an ironing device of the production apparatus according to the exemplary embodiment.

The ironing device 200 illustrated in FIGS. 7 and 8 is one example of an apparatus used for ironing a circular tubular metal body formed by impact-pressing a metal blank by using the impact pressing device. Specifically, the ironing device 200 is an apparatus that irons the circular tubular metal body 410 formed by impact-pressing the slag 30 by using the impact pressing device 10.

More specifically, as illustrated in FIGS. 7 and 8, the ironing device 200 includes a columnar mold 210 and a press mold 220.

The columnar mold 210 is a column-shaped mold having a tip-side portion to be inserted into the circular tubular metal body 410 formed by impact-pressing by the impact pressing device 10. The outer diameter of the columnar mold 210 is smaller than the inner diameter of the circular tubular metal body 410.

Thus, as illustrated in FIG. 8, when the tip-side portion (the lower portion in the drawing) is inserted into the circular tubular metal body 410 (when the circular tubular metal body 410 is fitted to the columnar mold 210), a clearance is formed between the outer peripheral surface of the columnar mold 210 and the inner peripheral surface of the circular tubular metal body 410.

The columnar mold 210 is configured to move up and down (in FIG. 8, the −Y direction and the +Y direction) when driving force is transmitted from a driving source not illustrated in the drawings.

The press mold 220 is a mold that presses the circular tubular metal body 410 against the outer peripheral surface of the columnar mold 210. As illustrated in FIG. 7, the press mold 220 has a ring shape coaxial with the columnar mold 210. The press mold 220 has a ring-shaped protrusion 223 protruding inward in the radial direction of the press mold 220.

The inner diameter of the protrusion 223 is larger than the outer diameter of the columnar mold 210 and is smaller than the outer diameter of the circular tubular metal body 410 before ironing.

As illustrated in FIG. 8, in the ironing device 200, the columnar mold 210 to which the circular tubular metal body 410 is fitted is moved downward so that the circular tubular metal body 410 passes through the inner part of the press mold 220 and so that the press mold 220 presses the circular tubular metal body 410 against the outer peripheral surface of the columnar mold 210. The shape of the circular tubular metal body 410 is corrected by this ironing. As a result, the inner diameter, the outer diameter, the circularity, etc., of the circular tubular metal body 410 are adjusted.

Cutting Device 300

The cutting device 300 illustrated in FIGS. 9 and 10 is a device that cuts the axis-direction end portion 425 in which the bottom part 412 of the circular tubular metal body 410 subjected to ironing with the ironing device 200 is formed.

As illustrated in FIG. 9, the cutting device 300 has a cutter 310 (cutting unit) that cuts the axis-direction end portion 425 of the circular tubular metal body 410. As illustrated in FIG. 10, the cutter 310 of the cutting device 300 cuts the axis-direction end portion 425 of the circular tubular metal body 410, and, thus, a circular tubular metal body 400 having two open ends in the axis direction is obtained.

Next, an example of the method for producing a circular tubular metal body by using the production apparatus according to an exemplary embodiment is described.

Production Method

A method for producing a circular tubular metal body 400 is described. This production method includes a preparation step, an impact pressing step, an ironing step, a cutting step, and a washing step.

Preparation Step

In the preparation step, the production apparatus 100 that includes the impact pressing device 10, the ironing device 200, and the cutting device 300 is prepared. In the preparation step, the slag 30 described above is prepared.

Impact Pressing Step

In the impact pressing step, a lubricant is first applied to a surface of the slag 30. The lubricant is applied to the slag 30 to suppress scratches on the slag 30 caused by contact with the punch 40 and the die 20.

The lubricant may be any but may be a powdery solid lubricant from the viewpoint of suppressing thickness deviation. The solid lubricant may be a fatty acid metal salt. Examples of the fatty acid metal salt include zinc stearate, calcium stearate, magnesium stearate, and aluminum stearate.

Next, as illustrated in FIGS. 1 and 2, the slag 30 with the lubricant applied to the surface thereof is placed in the cavity 22 of the die 20 in the impact pressing device 10. The slag 30 is placed on the bottom surface 23 of the cavity 22 and does not enter the groove 24. In other words, the slag 30 is placed on the bottom surface 23 of the cavity 22 while there is a space inside the groove 24.

Next, as illustrated in FIGS. 3 and 4, the punch 40 above the die 20 is descended and inserted into the cavity 22. As a result, the punch 40 squashes and deforms the slag 30 placed in the cavity 22. In other words, the punch 40 presses the slag 30. As a result, the slag 30 becomes elongated from the cavity 22 so as to cover the perimeter of the punch 40 and form a circular tubular metal body 410 having a bottom part 412.

During this process, part of the slag 30 enters the groove 24. Specifically, the bottom-surface-23-side outer peripheral portion 35 of the slag 30 enters the groove 24. The outer peripheral portion 35 that has entered the groove 24 is detained. Specifically, the outer peripheral portion 35 that has entered the groove 24 stays in the portion that constitutes an axis-direction end portion of the circular tubular metal body 410 to be formed. More specifically, the outer peripheral portion 35 that has entered the groove 24 stays in the groove 24. The center portion 37 of the slag 30 does not enter the groove 24 but passes between the inner peripheral surface 22N of the cavity 22 and the outer peripheral surface of the punch 40 by being pressed with the punch 40.

Next, the punch 40 is moved upward to allow the punch 40 to pass through the through hole 62 in the stripper 60 and remove the circular tubular metal body 410 from the punch 40. As a result, the circular tubular metal body 410 is formed.

Ironing Step

In the ironing step, first, as illustrated in FIG. 8, the tip-side portion of the columnar mold 210 is inserted into the circular tubular metal body 410.

Next, the columnar mold 210 is moved downward so that the circular tubular metal body 410 passes through the inner part of the press mold 220. As a result, the press mold 220 presses the circular tubular metal body 410 against the outer peripheral surface of the columnar mold 210.

Consequently, the circular tubular metal body 410 plastically deforms along the outer peripheral surface of the columnar mold 210, and the shape of the circular tubular metal body 410 is corrected. Next, the circular tubular metal body 410 with the corrected shape is released from the columnar mold 210.

Cutting Step

As illustrated in FIG. 10, in the cutting step, the cutter 310 of the cutting device 300 cuts the axis-direction end portion 425, in which the bottom part 412 is formed, of the circular tubular metal body 410. As a result, a circular tubular metal body 400 having tow open ends in the axis direction is obtained.

Washing Step

In the washing step, the surface of the circular tubular metal body 400 is washed. As a result, the lubricant applied to the slag 30 in the impact pressing step is removed. The washing method used in the washing step is not particularly limited, and any known method can be employed. Specific examples of the washing method include immersion washing that involves immersion in a detergent, flow washing that involves immersion in a flowing detergent, supersonic washing, scrub washing, and shower washing. As a result, the circular tubular metal body 400 is produced. Alternatively, the production method may omit application of the lubricant to the slag 30. In this case, the washing step is not performed.

Operation of the Production Apparatus and the Production Method of Exemplary Embodiments According to the production apparatus and the production method of the exemplary embodiments, the groove 24 has a function of detaining the slag 30 that has entered the groove 24 by being pressed with the punch 40. In addition, a portion of the slag 30, in which the surface roughness has increased by deformation caused by pressing with the punch 40, is detained, and thus, movement of this portion toward the tubular part 413 of the circular tubular metal body 410 to be formed is suppressed.

Thus, compared to a structure in which the slag 30 that has entered the groove 24 by being pressed with the punch 40 moves into the tubular part 413 of the circular tubular metal body 410 to be formed without detention, generation of a shock line in the axis-direction center-side portion of the tubular part 413 of the circular tubular metal body 410 is suppressed. As mentioned above, a shock line is a region that has a surface roughness larger than those of other regions. The shock line occurs along the circumferential direction of the circular tubular metal body 410.

In this exemplary embodiment, specifically, the groove 24 detains the bottom-surface-23-side outer peripheral portion 35 of the slag 30 that has entered the groove 24 by being pressed with the punch 40.

Here, the outer peripheral portion 35 of the slag 30 is a portion that easily undergoes an increase in surface roughness due to free deformation (unrestrained deformation) caused by pressing with the punch 40 and due to the resulting appearance of the coarse crystal grains. Thus, compared to a structure in which the outer peripheral portion 35 that has entered the groove 24 by being pressed with the punch 40 moves into the tubular part 413 of the circular tubular metal body 410 to be formed without detention, generation of a shock line at the axis-direction center-side portion of the tubular part 413 of the circular tubular metal body 410 is suppressed.

In the exemplary embodiment, more specifically, the groove 24 causes the outer peripheral portion 35 of the slag 30 to stay in a portion that constitutes an axis-direction end portion of the circular tubular metal body 410 to be formed.

Thus, compared to a structure in which the outer peripheral portion 35 that has entered the groove 24 by being pressed with the punch 40 moves beyond the axis-direction end portion of the circular tubular metal body 410 to be formed, generation of a shock line at the axis-direction center-side portion of the tubular part 413 of the circular tubular metal body 410 is suppressed.

Moreover, in this exemplary embodiment, the groove 24 causes the outer peripheral portion 35 of the slag 30 to stay within the groove 24. Thus, compared to a structure in which the outer peripheral portion 35 that has entered the groove 24 by being pressed with the punch 40 moves out of the groove 24, generation of a shock line at the axis-direction center-side portion of the tubular part 413 of the circular tubular metal body 410 to be formed is suppressed.

In this exemplary embodiment, the center portion 37 of the slag 30 does not enter the groove 24 but passes between the inner peripheral surface 22N of the cavity 22 and the outer peripheral surface of the punch 40 by being pressed with the punch 40.

Here, the center portion 37 of the slag 30 is a portion that does not easily undergo an increase in surface roughness compared to the outer peripheral portion 35. Thus, compared to a structure in which the center portion 37 of the slag 30 is allowed to stay inside the groove 24, the center portion 37 of the slag 30 is effectively used as a material for the tubular part 413 of the circular tubular metal body 410 to be formed, and thus the material efficiency is improved.

As such, in this embodiment, since generation of a shock line in the axis-direction center-side portion of the tubular part 413 of the circular tubular metal body 410 to be formed is suppressed, a circular tubular metal body 410 in which generation of a shock line in the tubular part 413 is suppressed is obtained.

By the production apparatus and the production method of the aforementioned exemplary embodiments, a circular tubular metal body 410 that has a tubular part 413 having an opening at one end in the axis direction of the tubular part 413, and a bottom part 412 at another end of the tubular part 413 in the axis direction, and that satisfies the condition (1) and at least one of the conditions (2) and (3) is obtained.

The circular tubular metal body 410 may be directly used as a product. Alternatively, a circular tubular metal body 410 obtained by removing the protrusion (the protrusion formed by the slag 30 entering the groove 24) protruding from the edge of the bottom part 412 of the circular tubular metal body may be used as a product.

Yet alternatively, a circular tubular metal body 400 obtained by cutting the axis-direction end portion 425, in which the bottom part 412 is formed, of the circular tubular metal body 410 may be used as a product.

In the production apparatus and the production method of the exemplary embodiments, the ironing device 200 (refer to FIGS. 7 and 8) and the ironing step, and the cutting device 300 (refer to FIGS. 9 and 10) and the cutting step are optional and can be employed as needed.

The present disclosure is not limited to the exemplary embodiments described above, and various alterations, modifications, and improvements are possible without departing from the gist of the present disclosure. For example, any of the modification examples described above may be combined as appropriate.

Conductive Substrate for Electrophotographic Photoreceptor

A conductive substrate for an electrophotographic photoreceptor according to an exemplary embodiment (hereinafter may also be referred to as the "conductive substrate") is formed of a tubular metal body according to the aforementioned exemplary embodiment. The conductive substrate of this exemplary embodiment may be obtained by the aforementioned method for producing a tubular metal body according to the exemplary embodiment described above.

The surface of the conductive substrate may be roughened to a center-line average roughness Ra of 0.04 μm or more and 0.5 μm or less in order to suppress interference fringes that occur when the electrophotographic photoreceptor used in a laser printer is irradiated with a laser beam. When incoherent light is used as a light source, there is no need to roughen the surface to prevent interference fringes, but roughening the surface suppresses generation of defects due to irregularities on the surface of the conductive substrate and thus is desirable for extending the lifetime.

Examples of the surface roughening method include a wet honing method with which an abrasive suspended in water is sprayed onto a conductive support, a centerless grinding with which a conductive substrate is pressed against a rotating grinding stone to perform continuous grinding, and an anodization treatment.

Another example of the surface roughening method does not involve roughening the surface of a conductive substrate but involves dispersing a conductive or semi-conductive powder in a resin and forming a layer of the resin on a surface of a conductive substrate so as to create a rough surface by the particles dispersed in the layer.

The surface roughening treatment by anodization involves forming an oxide film on the surface of a conductive substrate by anodization by using a metal (for example, aluminum) conductive substrate as the anode in an electrolyte solution. Examples of the electrolyte solution include a sulfuric acid solution and an oxalic acid solution. However, a porous anodization film formed by anodization is chemically active as is, is prone to contamination, and has resistivity that significantly varies depending on the environment. Thus, a pore-sealing treatment may be performed on the porous anodization film so as to seal fine pores in the oxide film by volume expansion caused by hydrating reaction in pressurized steam or boiling water (a metal salt such as a nickel salt may be added) so that the oxide is converted into a more stable hydrous oxide.

The thickness of the anodization film may be, for example, 0.3 μm or more and 15 μm or less. When the thickness is within this range, a barrier property against injection tends to be exhibited, and the increase in residual potential caused by repeated use tends to be suppressed.

The conductive substrate may be subjected to a treatment with an acidic treatment solution or a Boehmite treatment.

The treatment with an acidic treatment solution is, for example, conducted as follows. First, an acidic treatment solution containing phosphoric acid, chromic acid, and hydrofluoric acid is prepared. The blend ratios of phosphoric acid, chromic acid, and hydrofluoric acid in the acidic treatment solution may be, for example, in the range of 10 mass % or more and 11 mass % or less for phosphoric acid, in the range of 3 mass % or more and 5 mass % or less for chromic acid, and in the range of 0.5 mass % or more and 2 mass % or less for hydrofluoric acid; and the total concentration of these acids may be in the range of 13.5 mass % or more and 18 mass % or less. The treatment temperature may be, for example, 42° C. or more and 48° C. or less. The thickness of the film may be 0.3 μm or more and 15 μm or less.

The Boehmite treatment is conducted by immersing a conductive substrate in pure water at 90° C. or higher and 100° C. or lower for 5 to 60 minutes or by bringing a conductive substrate into contact with pressurized steam at 90° C. or higher and 120° C. or lower for 5 to 60 minutes. The thickness of the film may be 0.1 μm or more and 5 μm or less. The Boehmite-treated body may be further anodized by using an electrolyte solution, such as adipic acid, boric acid, a borate salt, a phosphate salt, a phthalate salt, a maleate salt, a benzoate salt, a tartrate salt, or a citrate salt, that has low film-dissolving power.

Electrophotographic Photoreceptor

An electrophotographic photoreceptor of an exemplary embodiment includes the conductive substrate according to the aforementioned exemplary embodiment, and a photosensitive layer on the conductive substrate.

Figure 12:
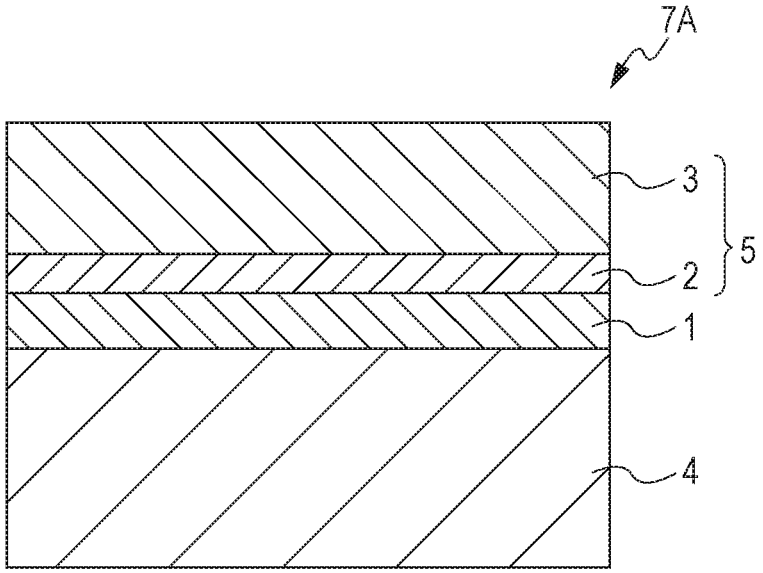
FIG. 12 is a schematic partial cross-sectional view of one example of the structure of a photoreceptor according to an exemplary embodiment.

FIG. 12 is a schematic cross-sectional view of one example of the layer structure of an electrophotographic photoreceptor 7A. The electrophotographic photoreceptor 7A illustrated in FIG. 12 has a structure in which an undercoat layer 1, a charge generating layer 2, and a charge transporting layer 3 are stacked in this order on a conductive substrate 4, and the charge generating layer 2 and the charge transporting layer 3 constitute a photosensitive layer 5.

Figure 13:
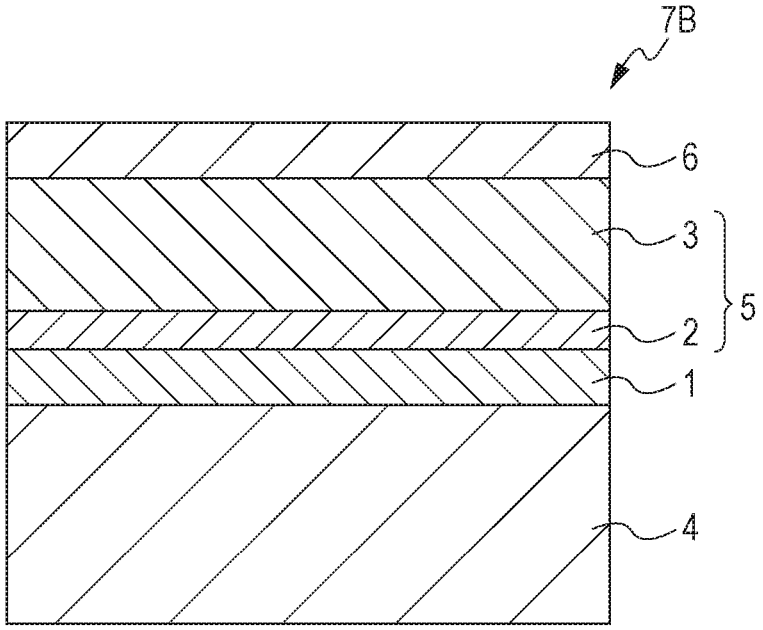
FIG. 13 is a schematic partial cross-sectional view of another example of the structure of the photoreceptor according to the exemplary embodiment.
Figure 14:
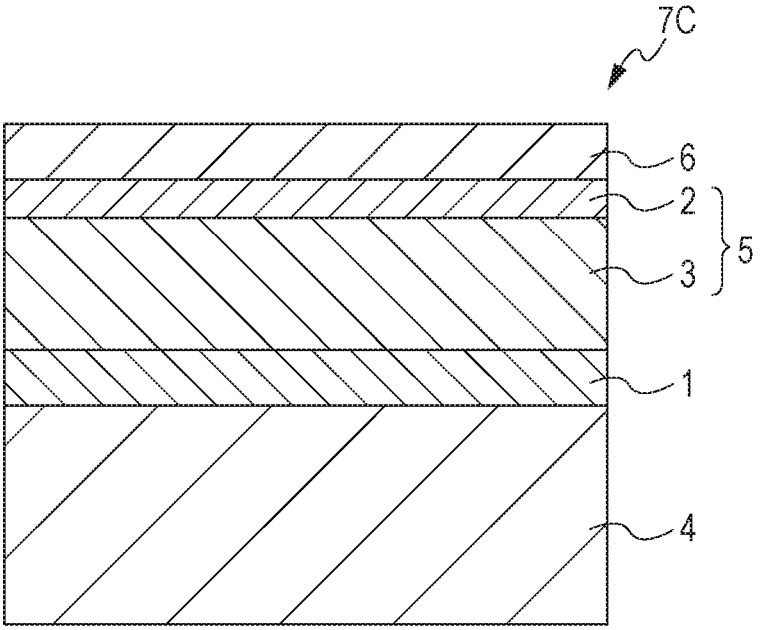
FIG. 14 is a schematic partial cross-sectional view of another example of the structure of the photoreceptor according to the exemplary embodiment.

FIGS. 13 and 14 are each a schematic cross-sectional view of another example of the layer structure of an electrophotographic photoreceptor of an exemplary embodiment.

Electrophotographic photoreceptors 7B and 7C illustrated in FIGS. 13 and 14 are each equipped with a photosensitive layer 5 in which the functions are separated between the charge transporting layer 2 and the charge transporting layer 3 as with the electrophotographic photoreceptor 7A illustrated in FIG. 12, and a protective layer 6 is formed as the outermost layer. The electrophotographic photoreceptor 7B illustrated in FIG. 13 has a structure in which an undercoat layer 1, a charge generating layer 2, a charge transporting layer 3, and a protective layer 6 are stacked in this order on a conductive substrate 4. An electrophotographic photoreceptor 7C illustrated in FIG. 14 has a structure in which an undercoat layer 1, a charge transporting layer 3, a charge generating layer 2, and a protective layer 6 are stacked in this order on a conductive substrate 4.

In the electrophotographic photoreceptors 7A top 7C, the undercoat layer 1 is optional. Alternatively, the electrophotographic photoreceptors 7A to 7C may each include a single-layer-type photosensitive layer in which the functions of the charge generating layer 2 and the charge transporting layer 3 are integrated.

In the description below, the respective layers of the electrophotographic photoreceptor are described in detail. In the description below, the reference signs are omitted.

Undercoat Layer

The undercoat layer is, for example, a layer that contains inorganic particles and a binder resin.

Examples of the inorganic particles include inorganic particles having a powder resistivity (volume resistivity) of $10^2$ Ωcm or more and $10^{11}$ Ωcm or less.

As the inorganic particles having this resistance value, for example, metal oxide particles such as tin oxide particles, titanium oxide particles, zinc oxide particles, or zirconium oxide particles are preferable, and, in particular, zinc oxide particles are preferable.

The specific surface area of the inorganic particles measured by the BET method may be, for example, 10 $m^2/g$ or more.

The volume-average particle diameter of the inorganic particles may be, for example, 50 nm or more and 2000 nm or less (or may be 60 nm or more and 1000 nm or less).

The amount of the inorganic particles contained relative to the binder resin is, for example, preferably 10 mass % or more and 80 mass % or less, and is more preferably 40 mass % or more and 80 mass % or less.

The inorganic particles may be surface-treated. A mixture of two or more inorganic particles subjected to different surface treatments or having different particle diameters may be used.

Examples of the surface treatment agent include a silane coupling agent, a titanate-based coupling agent, an aluminum-based coupling agent, and a surfactant. In particular, a silane coupling agent is preferable, and an amino-group-containing silane coupling agent is more preferable.

Examples of the amino-group-containing silane coupling agent include, but are not limited to, 3-aminopropyltriethoxysilane, N-2-(aminoethyl)-3-aminopropyltrimethoxysilane, N-2-(aminoethyl)-3-aminopropylmethyldimethoxysilane, and N,N-bis(2-hydroxyethyl)-3-aminopropyltriethoxysilane.

Two or more silane coupling agents may be mixed and used. For example, an amino-group-containing silane coupling agent may be used in combination with an additional silane coupling agent. Examples of this additional silane coupling agent include, but are not limited to, vinyltrimethoxysilane, 3-methacryloxypropyl-tris(2-methoxyethoxy)silane, 2-(3,4-epoxycyclohexyl)ethyltrimethoxysilane, 3-glycidoxypropyltrimethoxysilane, vinyltriacetoxysilane, 3-mercaptopropyltrimethoxysilane, 3-aminopropyltriethoxysilane, N-2-(aminoethyl)-3-aminopropyltrimethoxysilane, N-2-(aminoethyl)-3-aminopropylmethyldimethoxysilane, N,N-bis(2-hydroxyethyl)-3-aminopropyltriethoxysilane, and 3-chloropropyltrimethoxysilane.

The surface treatment method that uses a surface treatment agent may be any known method, for example, may be a dry method or a wet method.

The treatment amount of the surface treatment agent may be, for example, 0.5 mass % or more and 10 mass % or less relative to the inorganic particles.

Here, the undercoat layer may contain inorganic particles and an electron-accepting compound (acceptor compound) from the viewpoints of long-term stability of electrical properties and carrier blocking properties.

Examples of the electron-accepting compound include electron transporting substances, such as quinone compounds such as chloranil and bromanil; tetracyanoquinodimethane compounds; fluorenone compounds such as 2,4,7-trinitrofluorenone and 2,4,5,7-tetranitro-9-fluorenone; oxadiazole compounds such as 2-(4-biphenyl)-5-(4-t-butylphenyl)-1,3,4-oxadiazole, 2,5-bis(4-naphthyl)-1,3,4-oxadiazole, and 2,5-bis(4-diethylaminophenyl)-1,3,4-oxadiazole; xanthone compounds; thiophene compounds; and diphenoquinone compounds such as 3,3',5,5'-tetra-t-butyldiphenoquinone.

In particular, a compound having an anthraquinone structure may be used as the electron-accepting compound. Examples of the compound having an anthraquinone structure include hydroxyanthraquinone compounds, aminoanthraquinone compounds, and aminohydroxyanthraquinone compounds, and more specific examples thereof include anthraquinone, alizarin, quinizarin, anthrarufin, and purpurin.

The electron-accepting compound may be dispersed in the undercoat layer along with the inorganic particles, or may be attached to the surfaces of the inorganic particles.

Examples of the method for attaching the electron-accepting compound onto the surfaces of the inorganic particles include a dry method and a wet method.

The dry method is, for example, a method with which, while inorganic particles are stirred with a mixer or the like having a large shear force, an electron-accepting compound as is or dissolved in an organic solvent is added dropwise or sprayed along with dry air or nitrogen gas so as to cause the electron-accepting compound to attach to the surfaces of the inorganic particles. When the electron-accepting compound is added dropwise or sprayed, the temperature may be equal to or lower than the boiling point of the solvent. After the electron-accepting compound is added dropwise or sprayed, baking may be further conducted at 100° C. or higher. The temperature and time for baking are not particularly limited as long as the electrophotographic properties are obtained.

The wet method is, for example, a method with which, while inorganic particles are dispersed in a solvent by stirring, ultrasonically, or by using a sand mill, an attritor, or a ball mill, the electron-accepting compound is added, followed by stirring or dispersing, and then the solvent is removed to cause the electron-accepting compound to attach to the surfaces of the inorganic particles. The solvent is removed by, for example, filtration or distillation. After removing the solvent, baking may be further conducted at 100° C. or higher. The temperature and time for baking are not particularly limited as long as the electrophotographic properties are obtained. In the wet method, the moisture contained in the inorganic particles may be removed before adding the electron-accepting compound. For example, the moisture may be removed by stirring and heating the inorganic particles in a solvent or by boiling together with the solvent.

Attaching the electron-accepting compound may be conducted before, after, or simultaneously with the surface treatment of the inorganic particles by a surface treatment agent.

The amount of the electron-accepting compound contained relative to the inorganic particles may be, for example, 0.01 mass % or more and 20 mass % or less, and is preferably 0.01 mass % or more and 10 mass % or less.

Examples of the binder resin used in the undercoat layer include known materials such as known polymer compounds such as acetal resins (for example, polyvinyl butyral), polyvinyl alcohol resins, polyvinyl acetal resins, casein resins, polyamide resins, cellulose resins, gelatin, polyurethane resins, polyester resins, unsaturated polyester resins, methacrylic resins, acrylic resins, polyvinyl chloride resins, polyvinyl acetate resins, vinyl chloride-vinyl acetate-maleic anhydride resins, silicone resins, silicone-alkyd resins, urea resins, phenolic resins, phenol-formaldehyde resins, melamine resins, urethane resins, alkyd resins, and epoxy resins; zirconium chelate compounds; titanium chelate compounds; aluminum chelate compounds; titanium alkoxide compounds; organic titanium compounds; and silane coupling agents.

Other examples of the binder resin used in the undercoat layer include charge transporting resins that have charge transporting groups, and conductive resins (for example, polyaniline).

Among these, a resin that is insoluble in the coating solvent in the overlying layer is suitable as the binder resin used in the undercoat layer. Examples of the particularly suitable resin include thermosetting resins such as a urea resin, a phenolic resin, a phenol-formaldehyde resin, a melamine resin, a urethane resin, an unsaturated polyester resin, an alkyd resin, and an epoxy resin; and a resin obtained by a reaction between a curing agent and at least one resin selected from the group consisting of a polyamide resin, a polyester resin, a polyether resin, a methacrylic resin, an acrylic resin, a polyvinyl alcohol resin, and a polyvinyl acetal resin.

When two or more of these binder resins are used in combination, the mixing ratios are set as necessary.

The undercoat layer may contain various additives to improve electrical properties, environmental stability, and image quality.

Examples of the additives include known materials such as electron transporting pigments based on polycyclic condensed materials and azo materials, zirconium chelate compounds, titanium chelate compounds, aluminum chelate compounds, titanium alkoxide compounds, organic titanium compounds, and silane coupling agents. The silane coupling agent is used to surface-treat the metal oxide particles as mentioned above, but may be further added as an additive to the undercoat layer.

Examples of the silane coupling agent used as an additive include vinyltrimethoxysilane, 3-methacryloxypropyl-tris(2-methoxyethoxy)silane, 2-(3,4-epoxycyclohexyl)ethyltrimethoxysilane, 3-glycidoxypropyltrimethoxysilane, vinyltriacetoxysilane, 3-mercaptopropyltrimethoxysilane, 3-aminopropyltriethoxysilane, N-2-(aminoethyl)-3-aminopropyltrimethoxysilane, N-2-(aminoethyl)-3-aminopropylmethyldimethoxysilane, N,N-bis(2-hydroxyethyl)-3-aminopropyltriethoxysilane, and 3-chloropropyltrimethoxysilane.

Examples of the zirconium chelate compounds include zirconium butoxide, zirconium ethyl acetoacetate, zirconium triethanolamine, acetylacetonate zirconium butoxide, ethyl acetoacetate zirconium butoxide, zirconium acetate, zirconium oxalate, zirconium lactate, zirconium phosphonate, zirconium octanoate, zirconium naphthenate, zirconium laurate, zirconium stearate, zirconium isostearate, methacrylate zirconium butoxide, stearate zirconium butoxide, and isostearate zirconium butoxide.

Examples of the titanium chelate compounds include tetraisopropyl titanate, tetra-n-butyl titanate, butyl titanate dimer, tetra(2-ethylhexyl) titanate, titanium acetylacetonate, polytitanium acetylacetonate, titanium octylene glycolate, titanium lactate ammonium salt, titanium lactate, titanium lactate ethyl ester, titanium triethanol aminate, and polyhydroxy titanium stearate.

Examples of the aluminum chelate compounds include aluminum isopropylate, monobutoxyaluminum diisopropylate, aluminum butylate, diethylacetoacetate aluminum diisopropylate, and aluminum tris(ethylacetoacetate).

These additives may be used alone, or two or more compounds may be used as a mixture or a polycondensation product.

The undercoat layer may have a Vickers hardness of 35 or more.

In order to suppress moire images, the surface roughness (ten-point average roughness) of the undercoat layer may be adjusted to be in the range of 1/(4n) (n represents the refractive index of the overlying layer) to ½ of λ representing the laser wavelength used for exposure.

In order to adjust the surface roughness, resin particles and the like may be added to the undercoat layer. Examples of the resin particles include silicone resin particles and crosslinking polymethyl methacrylate resin particles. The surface of the undercoat layer may be polished to adjust the surface roughness. Examples of the polishing method included buff polishing, sand blasting, wet honing, and grinding.

The undercoat layer may be formed by any known method. For example, a coating film is formed by using an undercoat layer-forming solution prepared by adding the above-mentioned components to a solvent, dried, and, if needed, heated.

Examples of the solvent used for preparing the undercoat layer-forming solution include known organic solvents, such as alcohol solvents, aromatic hydrocarbon solvents, halogenated hydrocarbon solvents, ketone solvents, ketone alcohol solvents, ether solvents, and ester solvents.

Specific examples of the solvent include common organic solvents such as methanol, ethanol, n-propanol, iso-propanol, n-butanol, benzyl alcohol, methyl cellosolve, ethyl cellosolve, acetone, methyl ethyl ketone, cyclohexanone, methyl acetate, ethyl acetate, n-butyl acetate, dioxane, tetrahydrofuran, methylene chloride, chloroform, chlorobenzene, and toluene.

Examples of the method for dispersing inorganic particles in preparing the undercoat layer-forming solution include known methods that use a roll mill, a ball mill, a vibrating ball mill, an attritor, a sand mill, a colloid mill, and a paint shaker.

Examples of the method for applying the undercoat layer-forming solution to the conductive substrate include common methods such as a blade coating method, a wire bar coating method, a spray coating method, a dip coating method, a bead coating method, an air knife coating method, and a curtain coating method.

The thickness of the undercoat layer is preferably set within the range of 15 μm or more, and more preferably within the range of 20 μm or more and 50 μm or less.

Intermediate Layer

Although not illustrated in the drawings, an intermediate layer may be further provided between the undercoat layer and the photosensitive layer.

The intermediate layer is, for example, a layer that contains a resin. Examples of the resin used in the intermediate layer include polymer compounds such as acetal resins (for example, polyvinyl butyral), polyvinyl alcohol resins, polyvinyl acetal resins, casein resins, polyamide resins, cellulose resins, gelatin, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenol-formaldehyde resins, and melamine resins.

The intermediate layer may contain an organic metal compound. Examples of the organic metal compound used in the intermediate layer include organic metal compounds containing metal atoms such as zirconium, titanium, aluminum, manganese, and silicon.

These compounds used in the intermediate layer may be used alone, or two or more compounds may be used as a mixture or a polycondensation product.

In particular, the intermediate layer may be a layer that contains an organic metal compound that contains zirconium atoms or silicon atoms.

The intermediate layer may be formed by any known method. For example, a coating film is formed by using an intermediate layer-forming solution prepared by adding the above-mentioned components to a solvent, dried, and, if needed, heated.

Examples of the application method for forming the intermediate layer include common methods such as a dip coating method, a lift coating method, a wire bar coating method, a spray coating method, a blade coating method, a knife coating method, and a curtain coating method.

The thickness of the intermediate layer may be set within the range of, for example, 0.1 μm or more and 3 μm or less. The intermediate layer may be used as the undercoat layer.

Charge Generating Layer

The charge generating layer is, for example, a layer that contains a charge generating material and a binder resin. The charge generating layer may be a vapor deposited layer of a charge generating material. The vapor deposited layer of the charge generating material may be used when an incoherent light such as a light emitting diode (LED) or an organic electro-luminescence (EL) image array is used.

Examples of the charge generating material include azo pigments such as bisazo and trisazo pigments; fused-ring aromatic pigments such as dibromoanthanthrone; perylene pigments; pyrrolopyrrole pigments; phthalocyanine pigments; zinc oxide; and trigonal selenium.

Among these, in order to be compatible to the near-infrared laser exposure, a metal phthalocyanine pigment or a metal-free phthalocyanine pigment may be used as the charge generating material. Specific examples thereof include hydroxygallium phthalocyanine, chlorogallium phthalocyanine, dichlorotin phthalocyanine, and titanyl phthalocyanine.

In order to be compatible to the near ultraviolet laser exposure, the charge generating material may be a fused-ring aromatic pigment such as dibromoanthanthrone, a thioindigo pigment, a porphyrazine compound, zinc oxide, trigonal selenium, a bisazo pigment.

When an incoherent light source, such as an LED or an organic EL image array having an emission center wavelength in the range of 450 nm or more and 780 nm or less, is used, the charge generating material described above may be used; however, from the viewpoint of the resolution, when the photosensitive layer is as thin as 20 μm or less, the electric field intensity in the photosensitive layer is increased, charges injected from the substrate are decreased, and image defects known as black spots tend to occur. This is particularly noticeable when a charge generating material, such as trigonal selenium or a phthalocyanine pigment, that is of a p-conductivity type and easily generates dark current is used.

In contrast, when an n-type semiconductor, such as a fused-ring aromatic pigment, a perylene pigment, or an azo pigment, is used as the charge generating material, dark current rarely occurs and, even when the thickness is small, image defects known as black spots can be suppressed.

Whether n-type or not is determined by a time-of-flight method commonly employed, on the basis of the polarity of the photocurrent flowing therein. A material in which electrons flow more smoothly as carriers than holes is determined to be of an n-type.

The binder resin used in the charge generating layer is selected from a wide range of insulating resins. Alternatively, the binder resin may be selected from organic photoconductive polymers, such as poly-N-vinylcarbazole, polyvinyl anthracene, polyvinyl pyrene, and polysilane.

Examples of the binder resin include, polyvinyl butyral resins, polyarylate resins (polycondensates of bisphenols and aromatic dicarboxylic acids etc.), polycarbonate resins, polyester resins, phenoxy resins, vinyl chloride-vinyl acetate copolymers, polyamide resins, acrylic resins, polyacrylamide resins, polyvinyl pyridine resins, cellulose resins, urethane resins, epoxy resins, casein, polyvinyl alcohol resins, and polyvinyl pyrrolidone resins. Here, "insulating" means having a volume resistivity of $10^{13}$ Ωcm or more.

These binder resins are used alone or in combination as a mixture.

The blend ratio of the charge generating material to the binder resin may be in the range of 10:1 to 1:10 on a mass ratio basis.

The charge generating layer may contain other known additives.

The charge generating layer may be formed by any known method. For example, a coating film is formed by using a charge generating layer-forming solution prepared by adding the above-mentioned components to a solvent, dried, and, if needed, heated. The charge generating layer may be formed by vapor-depositing a charge generating material. The charge generating layer may be formed by vapor deposition particularly when a fused-ring aromatic pigment or a perylene pigment is used as the charge generating material.

Specific examples of the solvent for preparing the charge generating layer-forming solution include methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene, and toluene. These solvents are used alone or in combination as a mixture.

In order to disperse particles (for example, the charge generating material) in the charge generating layer-forming solution, a media disperser such as a ball mill, a vibrating ball mill, an attritor, a sand mill, or a horizontal sand mill, or a media-less disperser such as stirrer, an ultrasonic disperser, a roll mill, or a high-pressure homogenizer can be used. Examples of the high-pressure homogenizer include a collision-type homogenizer in which the dispersion in a high-pressure state is dispersed through liquid-liquid collision or liquid-wall collision, and a penetration-type homogenizer in which the fluid in a high-pressure state is caused to penetrate through fine channels.

In dispersing, it is effective to set the average particle diameter of the charge generating material in the charge generating layer-forming solution to 0.5 μm or less, preferably 0.3 μm or less, and more preferably 0.15 μm or less.

Examples of the method for applying the charge generating layer-forming solution to the undercoat layer (or the intermediate layer) include common methods such as a blade coating method, a wire bar coating method, a spray coating method, a dip coating method, a bead coating method, an air knife coating method, and a curtain coating method.

The thickness of the charge generating layer is preferably set within the range of, for example, 0.1 μm or more and 5.0 μm or less, and more preferably within the range of 0.2 μm or more and 2.0 μm or less.

Charge Transporting Layer

The charge transporting layer is, for example, a layer that contains a charge transporting material and a binder resin. The charge transporting layer may be a layer that contains a polymer charge transporting material.

Examples of the charge transporting material include electron transporting compounds such as quinone compounds such as p-benzoquinone, chloranil, bromanil, and anthraquinone; tetracyanoquinodimethane compounds; fluorenone compounds such as 2,4,7-trinitrofluorenone; xanthone compounds; benzophenone compounds; cyanovinyl compounds; and ethylene compounds. Other examples of the charge transporting material include hole transporting compounds such as triarylamine compounds, benzidine compounds, aryl alkane compounds, aryl-substituted ethylene compounds, stilbene compounds, anthracene compounds, and hydrazone compounds. These charge transporting materials may be used alone or in combination, but are not limiting.

From the viewpoint of charge mobility, the charge transporting material may be a triaryl amine derivative represented by structural formula (a-1) below or a benzidine derivative represented by structural formula (a-2) below.

(a-1)

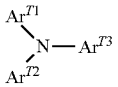

In structural formula (a-1), $Ar^{T1}$, $Ar^{T2}$, and $Ar^{T3}$ each independently represent a substituted or unsubstituted aryl group, $—C_6H_4—C(R^{T4})=C(R^{T5})(R^{T6})$, or $—C_6H_4—CH=CH—CH=C(R^{T7})(R^{T8})$. $R^{T4}$, $R^{T5}$, $R^{T6}$, $R^{T7}$, and $R^{T8}$ each independently represent a hydrogen atom, a substituted or unsubstituted alkyl group, or a substituted or unsubstituted aryl group.

Examples of the substituent for each of the groups described above include a halogen atom, an alkyl group having 1 to 5 carbon atoms, and an alkoxy group having 1 to 5 carbon atoms. Examples of the substituent for each of the groups described above include a substituted amino group substituted with an alkyl group having 1 to 3 carbon atoms.

(a-2)

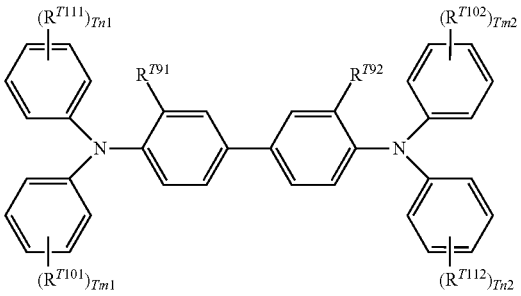

In structural formula (a-2), $R^{T91}$ and $R^{T92}$ each independently represent a hydrogen atom, a halogen atom, an alkyl group having 1 to 5 carbon atoms, or an alkoxy group having 1 to 5 carbon atoms. $R^{T101}$, $R^{T102}$, $R^{T111}$, and $R^{T112}$ each independently represent a halogen atom, an alkyl group having 1 to 5 carbon atoms, an alkoxy group having 1 to 5 carbon atoms, an amino group substituted with an alkyl group having 1 or 2 carbon atoms, a substituted or unsubstituted aryl group, $—C(R^{T12})=C(R^{T13})(R^{T14})$, or $—CH=CH—CH=C(R^{T15})(R^{T16})$; and $R^{T12}$, $R^{T13}$, $R^{T14}$, $R^{T15}$, and $R^{T16}$ each independently represent a hydrogen atom, a substituted or unsubstituted alkyl group, or a substituted or unsubstituted aryl group. Tm1, Tm2, Tn1, and Tn2 each independently represent an integer of 0 or more and 2 or less.

Examples of the substituent for each of the groups described above include a halogen atom, an alkyl group having 1 to 5 carbon atoms, and an alkoxy group having 1 to 5 carbon atoms. Examples of the substituent for each of the groups described above include a substituted amino group substituted with an alkyl group having 1 to 3 carbon atoms.

Here, among the triarylamine derivatives represented by structural formula (a-1) and the benzidine derivatives represented by structural formula (a-2) above, a triarylamine derivative having $—C_6H_4—CH=CH—CH=C(R^{T7})(R^{T8})$) or a benzidine derivative having $—CH=CH—CH=C(R^{T15})(R^{T16})$ may be used from the viewpoint of the charge mobility.

Examples of the polymer charge transporting material that can be used include known charge transporting materials such as poly-N-vinylcarbazole and polysilane. In particular, polyester polymer charge transporting materials may be used. The polymer charge transporting material may be used alone or in combination with a binder resin.

Examples of the binder resin used in the charge transporting layer include polycarbonate resins, polyester resins, polyarylate resins, methacrylic resins, acrylic resins, polyvinyl chloride resins, polyvinylidene chloride resins, polystyrene resins, polyvinyl acetate resins, styrene-butadiene copolymers, vinylidene chloride-acrylonitrile copolymers, vinyl chloride-vinyl acetate copolymers, vinyl chloride-vinyl acetate-maleic anhydride copolymers, silicone resins, silicone alkyd resins, phenol-formaldehyde resins, styrene-alkyd resins, poly-N-vinylcarbazole, and polysilane. Among these, a polycarbonate resin or a polyarylate resin may be used as the binder resin. These binder resins are used alone or in combination.

The blend ratio of the charge transporting material to the binder resin may be in the range of 10:1 to 1:5 on a mass ratio basis.

The charge transporting layer may contain other known additives.

The charge transporting layer may be formed by any known method. For example, a coating film is formed by using a charge transporting layer-forming solution prepared by adding the above-mentioned components to a solvent, dried, and, if needed, heated.

Examples of the solvent used to prepare the charge transporting layer-forming solution include common organic solvents such as aromatic hydrocarbons such as benzene, toluene, xylene, and chlorobenzene; ketones such as acetone and 2-butanone; halogenated aliphatic hydrocarbons such as methylene chloride, chloroform, and ethylene chloride; and cyclic or linear ethers such as tetrahydrofuran and ethyl ether. These solvents are used alone or in combination as a mixture.

Examples of the method for applying the charge transporting layer-forming solution to the charge generating layer include common methods such as a blade coating method, a wire bar coating method, a spray coating method, a dip coating method, a bead coating method, an air knife coating method, and a curtain coating method.

The thickness of the charge transporting layer is preferably set within the range of, for example, 5 μm or more and 50 μm or less, and more preferably within the range of 10 μm or more and 30 μm or less.

Protective Layer

A protective layer is disposed on a photosensitive layer if necessary. The protective layer is, for example, formed to avoid chemical changes in the photosensitive layer during charging and further improve the mechanical strength of the photosensitive layer.

Thus, the protective layer may be a layer formed of a cured film (crosslinked film). Examples of such a layer include layers indicated in 1) and 2) below.

1) A layer formed of a cured film of a composition that contains a reactive-group-containing charge transporting material having a reactive group and a charge transporting skeleton in the same molecule (in other words, a layer that contains a polymer or crosslinked body of the reactive-group-containing charge transporting material).

2) A layer formed of a cured film of a composition that contains a non-reactive charge transporting material, and a reactive-group-containing non-charge transporting material that does not have a charge transporting skeleton but has a reactive group (in other words, a layer that contains a polymer or crosslinked body of the non-reactive charge transporting material and the reactive-group-containing non-charge transporting material).

Examples of the reactive group contained in the reactive-group-containing charge transporting material include chain-polymerizable groups, an epoxy group, —OH, —OR (where R represents an alkyl group), $—NH_2$, —SH, —COOH, and $—SiR^{Q1}{}_{3-Qn}(OR^{Q2})_{Qn}$ (where $R^{Q1}$ represents a hydrogen atom, an alkyl group, or a substituted or unsubstituted aryl group, $R^{Q2}$ represents a hydrogen atom, an alkyl group, or a trialkylsilyl group, and Qn represents an integer of 1 to 3).

The chain-polymerizable group may be any radical-polymerizable functional group, and an example thereof is a functional group having a group that contains at least a carbon-carbon double bond. A specific example thereof is a group that contains at least one selected from a vinyl group, a vinyl ether group, a vinyl thioether group, a styryl group (vinylphenyl group), an acryloyl group, a methacryloyl group, and derivatives thereof. Among these, the chain-polymerizable group may be a group that contains at least one selected from a vinyl group, a vinylphenyl group, an acryloyl group, a methacryloyl group, and derivatives thereof due to their excellent reactivity.

The charge transporting skeleton of the reactive-group-containing charge transporting material may be any known structure used in the electrophotographic photoreceptor, and examples thereof include skeletons that are derived from nitrogen-containing hole transporting compounds, such as triarylamine compounds, benzidine compounds, and hydrazone compounds, and that are conjugated with nitrogen atoms. Among these, a triarylamine skeleton is preferable.

The reactive-group-containing charge transporting material that has such a reactive group and a charge transporting skeleton, the non-reactive charge transporting material, and the reactive-group-containing non-charge transporting material may be selected from among known materials.

The protective layer may contain other known additives.

The protective layer may be formed by any known method. For example, a coating film is formed by using a protective layer-forming solution prepared by adding the above-mentioned components to a solvent, dried, and, if needed, cured such as by heating.

Examples of the solvent used to prepare the protective layer-forming solution include aromatic solvents such as toluene and xylene, ketone solvents such as methyl ethyl ketone, methyl isobutyl ketone, and cyclohexanone, ester solvents such as ethyl acetate and butyl acetate, ether solvents such as tetrahydrofuran and dioxane, cellosolve solvents such as ethylene glycol monomethyl ether, and alcohol solvents such as isopropyl alcohol and butanol. These solvents are used alone or in combination as a mixture.

The protective layer-forming solution may be a solvent-free solution.

Examples of the application method used to apply the protective layer-forming solution onto the photosensitive layer (for example, the charge transporting layer) include common methods such as a dip coating method, a lift coating method, a wire bar coating method, a spray coating method, a blade coating method, a knife coating method, and a curtain coating method.

The thickness of the protective layer is preferably set within the range of, for example, 1 μm or more and 20 μm or less, and more preferably within the range of 2 μm or more and 10 μm or less.

Single-Layer-Type Photosensitive Layer

The single-layer-type photosensitive layer (charge generating/charge transporting layer) is, for example, a layer that contains a charge generating material, a charge transporting material, and, optionally, a binder resin and other known additives. These materials are the same as those described in relation to the charge generating layer and the charge transporting layer.

The amount of the charge generating material contained in the single-layer-type photosensitive layer relative to the total solid content may be 0.1 mass % or more and 10 mass % or less, and is preferably 0.8 mass % or more and 5 mass % or less. The amount of the charge transporting material contained in the single-layer-type photosensitive layer relative to the total solid content may be 5 mass % or more and 50 mass % or less.

The method for forming the single-layer-type photosensitive layer is the same as the method for forming the charge generating layer and the charge transporting layer.

The thickness of the single-layer-type photosensitive layer may be, for example, 5 μm or more and 50 μm or less, and is preferably 10 μm or more and 40 μm or less.

Image Forming Apparatus (and Process Cartridge)

An image forming apparatus of an exemplary embodiment includes an electrophotographic photoreceptor of the aforementioned exemplary embodiment, a charging unit that charges a surface of the electrophotographic photoreceptor, an electrostatic latent image forming unit that forms an electrostatic latent image on the charged surface of the electrophotographic photoreceptor, a developing unit that develops the electrostatic latent image on the surface of the electrophotographic photoreceptor by using a developer that contains a toner so as to form a toner image, and a transfer unit that transfers the toner image onto a surface of a recording medium. The electrophotographic photoreceptor of the exemplary embodiment described above is used as the electrophotographic photoreceptor.

The image forming apparatus of the exemplary embodiment is applied to a known image forming apparatus, examples of which include an apparatus equipped with a fixing unit that fixes the toner image transferred onto the surface of the recording medium; a direct transfer type apparatus with which the toner image formed on the surface of the electrophotographic photoreceptor is directly transferred to the recording medium; an intermediate transfer type apparatus with which the toner image formed on the surface of the electrophotographic photoreceptor is first transferred to a surface of an intermediate transfer body and then the toner image on the surface of the intermediate transfer body is transferred to the surface of the recording medium; an apparatus equipped with a cleaning unit that cleans the surface of the electrophotographic photoreceptor after the toner image transfer and before charging; an apparatus equipped with a charge erasing unit that erases the charges on the surface of the electrophotographic photoreceptor by applying the charge erasing light after the toner image transfer and before charging; and an apparatus equipped with an electrophotographic photoreceptor heating member that elevates the temperature of the electrophotographic photoreceptor to reduce the relative temperature.

In the intermediate transfer type apparatus, the transfer unit includes, for example, an intermediate transfer body having a surface onto which a toner image is to be transferred, a first transfer unit that conducts first transfer of the toner image on the surface of the electrophotographic photoreceptor onto the surface of the intermediate transfer body, and a second transfer unit that conducts second transfer of the toner image on the surface of the intermediate transfer body onto a surface of a recording medium.

The image forming apparatus of this exemplary embodiment may be of a dry development type or a wet development type (development type that uses a liquid developer).

In the image forming apparatus of the exemplary embodiment, for example, a section that includes the electrophotographic photoreceptor may be configured as a cartridge structure (process cartridge) detachably attachable to the image forming apparatus. A process cartridge equipped with the electrophotographic photoreceptor of the exemplary embodiment may be used as this process cartridge. The process cartridge may include, in addition to the electrophotographic photoreceptor, at least one selected from the group consisting of a charging unit, an electrostatic latent image forming unit, a developing unit, and a transfer unit.

Although some examples of the image forming apparatus of an exemplary embodiment are described below, these examples are not limiting. Only relevant sections illustrated in the drawings are described, and descriptions of other sections are omitted.

Figure 15:
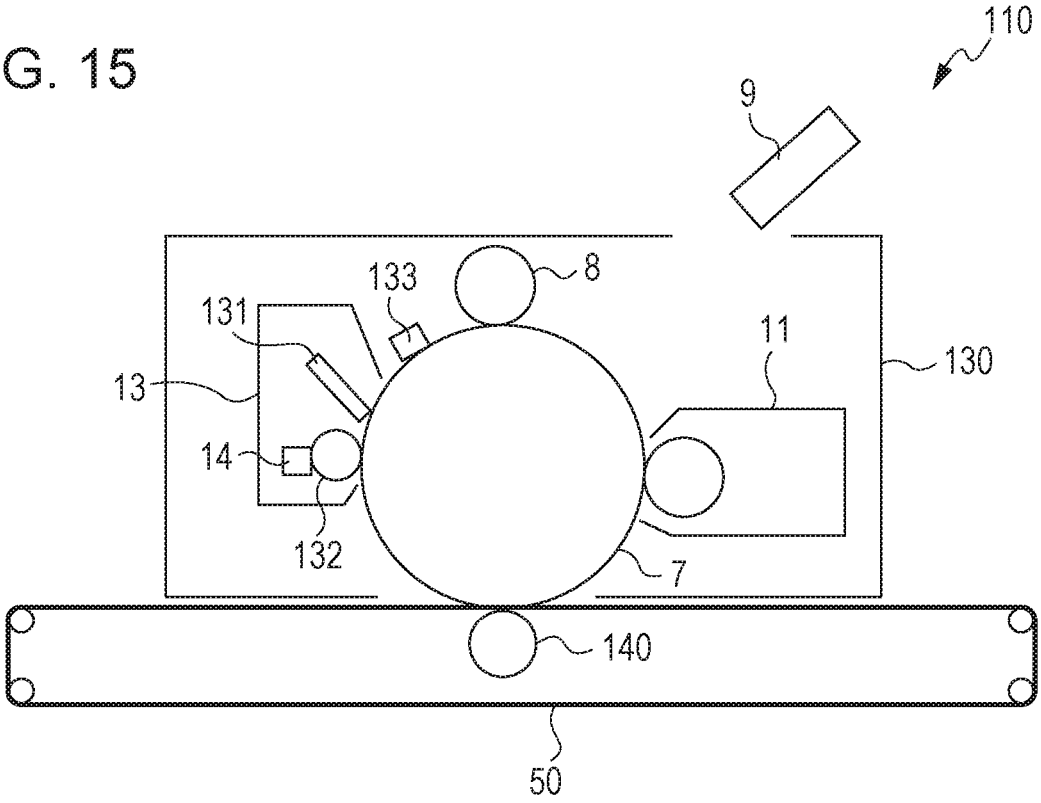
FIG. 15 is a schematic diagram illustrating one example of an image forming apparatus according to an exemplary embodiment.

FIG. 15 is a schematic diagram illustrating one example of an image forming apparatus according to an exemplary embodiment;

As illustrated in FIG. 15, an image forming apparatus 110 of this exemplary embodiment includes a process cartridge 130 equipped with an electrophotographic photoreceptor 7, an exposing device 9 (one example of the electrostatic latent image forming unit), a transfer device 140 (first transfer device), and an intermediate transfer body 50. In this image forming apparatus 110, the exposing device 9 is positioned so that light can be applied to the electrophotographic photoreceptor 7 from the opening of the process cartridge 130, the transfer device 140 is positioned to oppose the electrophotographic photoreceptor 7 with the intermediate transfer body 50 therebetween, and the intermediate transfer body 50 has a portion in contact with the electrophotographic photoreceptor 7. Although not illustrated in the drawings, a second transfer device that transfers the toner image on the intermediate transfer body 50 onto a recording medium (for example, a paper sheet) is also provided. The intermediate transfer body 50, the transfer device 140 (first transfer device), and the second transfer device (not illustrated) correspond to examples of the transfer unit.

The process cartridge 130 illustrated in FIG. 15 integrates and supports the electrophotographic photoreceptor 7, a charging device 8 (one example of the charging unit), a developing device 11 (one example of the developing unit), and a cleaning device 13 (one example of the cleaning unit) in the housing. The cleaning device 13 has a cleaning blade (one example of the cleaning member) 131, and the cleaning blade 131 is in contact with the surface of the electrophotographic photoreceptor 7. The cleaning member may take a form other than the cleaning blade 131, and may be a conductive or insulating fibrous member that can be used alone or in combination with the cleaning blade 131.

Although an example of the image forming apparatus equipped with a fibrous member 132 (roll) that supplies a lubricant 14 to the surface of the electrophotographic photoreceptor 7 and a fibrous member 133 (flat brush) that assists cleaning is illustrated in FIG. 15, these members are optional.

The features of the image forming apparatus of this exemplary embodiment will now be described.

Charging Device

Examples of the charging device 8 include contact-type chargers that use conductive or semi-conducting charging rollers, charging brushes, charging films, charging rubber blades, and charging tubes. Known chargers such as non-contact-type roller chargers, and scorotron chargers and corotron chargers that utilize corona discharge are also used.

Exposing Device

Examples of the exposing device 9 include optical devices that can apply light, such as semiconductor laser light, LED light, or liquid crystal shutter light, into a particular image shape onto the surface of the electrophotographic photoreceptor 7. The wavelength of the light source is to be within the spectral sensitivity range of the electrophotographic photoreceptor. The mainstream wavelength of the semiconductor lasers is near infrared having an oscillation wavelength at about 780 nm. However, the wavelength is not limited to this, and a laser having an oscillation wavelength on the order of 600 nm or a blue laser having an oscillation wavelength of 400 nm or more and 450 nm or less may be used. In order to form a color image, a surface-emitting laser light source that can output multi beams is also effective.

Developing Device

Examples of the developing device 11 include common developing devices that perform development by using a developer in contact or non-contact manner. The developing device 11 is not particularly limited as long as the aforementioned functions are exhibited, and is selected according to the purpose. An example thereof is a known developer that has a function of attaching a one-component developer or a two-component developer to the electrophotographic photoreceptor 7 by using a brush, a roller, or the like. In particular, a development roller that retains the developer on its surface may be used.

The developer used in the developing device 11 may be a one-component developer that contains only a toner or a two-component developer that contains a toner and a carrier. The developer may be magnetic or non-magnetic. Any known developers may be used as these developers.

Cleaning Device

A cleaning blade type device equipped with a cleaning blade 131 is used as the cleaning device 13.

Instead of the cleaning blade type, a fur brush cleaning type device or a development-cleaning simultaneous type device may be employed.

Transfer Device

Examples of the transfer device 140 include contact-type transfer chargers that use belts, rollers, films, rubber blades, etc., and known transfer chargers such as scorotron transfer chargers and corotron transfer chargers that utilize corona discharge.

Intermediate Transfer Body

A belt-shaped member (intermediate transfer belt) that contains semi-conducting polyimide, polyamide imide, polycarbonate, polyarylate, a polyester, a rubber or the like is used as the intermediate transfer body 50. The form of the intermediate transfer body other than the belt may be a drum.

Figure 16:
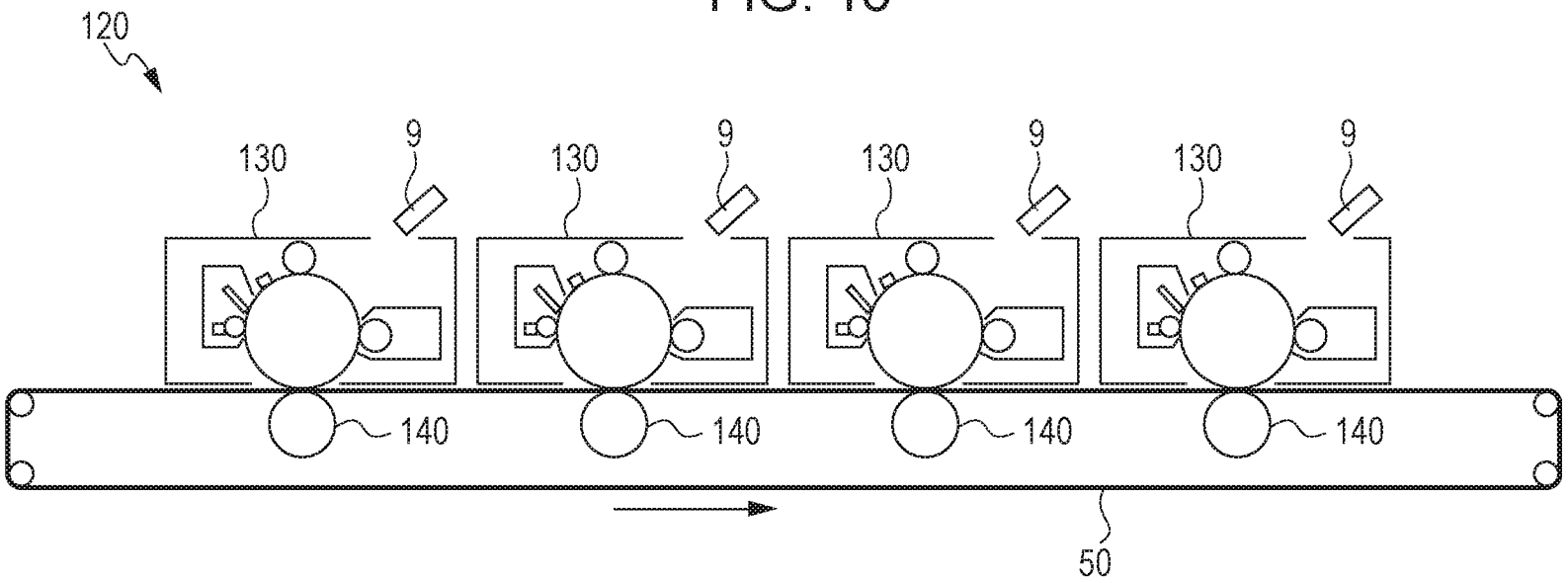
FIG. 16 is a schematic diagram illustrating another example of the image forming apparatus according to the exemplary embodiment.

FIG. 16 is a schematic diagram illustrating another example of the image forming apparatus according to the exemplary embodiment.

An image forming apparatus 120 illustrated in FIG. 16 is a tandem-system multicolor image forming apparatus equipped with four process cartridges 130. In the image forming apparatus 120, four process cartridges 130 are arranged in parallel on the intermediate transfer body 50, and one electrophotographic photoreceptor is used for one color. The image forming apparatus 120 is identical to the image forming apparatus 110 except for the tandem system.

EXAMPLES

Examples of the present disclosure will now be described in further detail, but the present disclosure is not limited by the examples. Unless otherwise noted, "parts" means "parts by mass".

Examples 1 to 6 and Comparative Examples 1 to 4

A column-shaped aluminum slag having a diameter of 34 mm and a thickness of 15 mm is prepared by punching out from an aluminum plate having a thickness of 15 mm and composed of a 1050 alloy (designation by JIS) having an aluminum purity of 99.5% or more. A circular tubular metal body having a diameter of 34 mm is formed by impact pressing.

Specifically, impact pressing is performed by using an impact pressing device having the same structure as the impact pressing device 10 described above and by setting the radius r (in the tables, this is noted as the radius of the die) of the cavity 22 of the die 20, and the maximum depth DA, the first distance L1 and the second distance L2 of the groove to values indicated in Tables 1 and 2 so as to form a circular tubular metal body.

In Examples 4 to 6 and Comparative Examples 3 and 4, ironing is performed after impact pressing.

Evaluation

Various Properties

The following properties of the circular tubular metal bodies of the respective examples are measured according to the aforementioned methods.

Surface Roughness Rz

- The surface roughness Rz2 of the outer peripheral surface of the center portion of the tubular part in the axis direction
- The ratio (Rz1/Rz2) of the surface roughness Rz1 of the outer peripheral surface of the bottom part to the surface roughness Rz2 of the outer peripheral surface of the center portion of the tubular part in the axis direction
- The difference (Rz1−Rz2) between the surface roughness Rz1 of the outer peripheral surface of the bottom part and the surface roughness Rz2 of the outer peripheral surface of the center portion of the tubular part in the axis direction Vickers hardness HV
- The Vickers hardness HV2 of the outer peripheral surface of the center portion of the tubular part in the axis direction
- The difference (HV2−HV1) between the Vickers hardness HV1 of the outer peripheral surface of the bottom part and the Vickers hardness HV2 of the outer peripheral surface of the center portion of the tubular part in the axis direction
- The ratio (HV1/HV2) of the Vickers hardness HV1 of the outer peripheral surface of the bottom part to the Vickers hardness HV2 of the outer peripheral surface of the center portion of the tubular part in the axis direction Average crystal grain diameter D
- The average crystal grain diameter D2 of the outer peripheral surface of the center portion of the tubular part in the axis direction
- The difference (D1−D2) between the average crystal grain diameter D1 of the outer peripheral surface of the bottom part and the average crystal grain diameter D2 of the outer peripheral surface of the center portion of the tubular part in the axis direction
- The ratio (D1/D2) of the average crystal grain diameter D1 of the outer peripheral surface of the bottom part to the average crystal grain diameter D2 of the outer peripheral surface of the center portion of the tubular part in the axis direction Other Properties

- Wall thickness
- Thickness deviation
- Wall thickness difference in the bottom part of the circular tubular metal body (in other words, the difference in wall thickness between the center portion of the bottom part and the edge (that is, the edge having a protrusion formed by the slag entering the groove of the die) of the bottom part)

In-Plane Evenness

In order to determine the in-plane evenness, the surface roughness Rz is measured on the outer peripheral surface at a total of eight points, namely, at circumferentially equally spaced four points at a position ¼ of the length of the circular tubular metal body in the axis direction and at circumferentially equally spaced four points at a position ¾ of the length of the circular tubular metal body in the axis direction, and the standard deviation σ (in the tables, indicated as σRz) of the observed values of the surface roughness Rz is used as the property value of the in-plane evenness.

Evaluation of Generation of Shock Line

The outer peripheral surface of the tubular part of the circular tubular metal body of each example is observed, and the extent of the occurrence of the shock line is evaluated by the following standard.

A: The surface is not clouded and has metallic luster.

B: The surface is slightly clouded but has metallic luster.

C: About one half of the region is clouded, and the metallic luster is a half that of a non-shock-line region.

D: About 75% or more of the region is clouded, and there is almost no metallic luster.

E: The region is entirely clouded, and there is no metallic luster.

Preparation of Photoreceptor

A photoreceptor is prepared as follows by using the circular tubular metal body obtained in each example as the conductive substrate.

However, a circular tubular metal body from which an end portion having a bottom part is removed is used as the conductive substrate.

Preparation of Photoreceptor

One hundred parts by mass of zinc oxide (trade name: MZ300 produced by Tayca Corporation), 10 parts by mass of a 10 mass % toluene solution of N-2-(aminoethyl)-3-aminopropyltriethoxysilane serving as a silane coupling agent, and 200 parts by mass of toluene are mixed, and the resulting mixture is stirred and refluxed for 2 hours. Then, toluene is distilled away at a reduced pressure of 10 mmHg and baking is performed at 135° C. for 2 hours to surface-treat zinc oxide with a silane coupling agent.

The surface-treated zinc oxide: 33 parts by mass, a blocked isocyanate (trade name: Sumidur 3175 produced by Sumitomo Bayer Urethane Co., Ltd.): 6 parts by mass, a compound represented by structural formula (AK-1) below: 1 part by mass, and methyl ethyl ketone: 25 parts by mass are mixed for 30 minutes. Then a butyral resin (S-LEC BM-1 produced by Sekisui Chemical Co., Ltd.): 5 parts by mass, a silicone ball (trade name: Tospearl 120 produced by Momentive Performance Materials Japan LLC): 3 parts by mass, and a silicone oil (trade name: SH29PA produced by Dow Corning Corp.) serving as a leveling agent: 0.01 parts by mass are added thereto, and the resulting mixture is dispersed in a sand mill for 3 hours to obtain an undercoat layer-forming solution.

The undercoat layer-forming solution is applied to the conductive substrate by a dip coating method, and dried and cured at 180° C. for 30 minutes so as to obtain an undercoat layer having a thickness of 30 μm.

(AK-1)

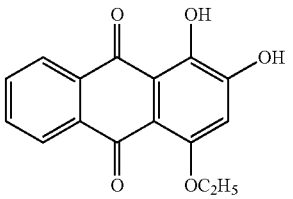

Next, a mixture containing a hydroxygallium phthalocyanine pigment (type-V hydroxygallium phthalocyanine pigment having diffraction peaks at least at Bragg's angles (2θ±0.2°) of 7.3°, 16.0°, 24.9°, and 28.0° in an X-ray diffraction spectrum obtained by using CuK α X-ray (maximum peak wavelength in the absorption spectrum in the wavelength range of 600 nm or more and 900 nm or less=820 nm, average particle diameter=0.12 μm, maximum particle diameter=0.2 μm, specific surface area=60 $m^2/g$)) serving as a charge generating material, a vinyl chloride-vinyl acetate copolymer resin (trade name: VMCH produced by Nippon Unicar Company Limited) serving as a binder resin, and n-butyl acetate is placed in a 100 mL glass jar along with glass beads having a diameter of 1.0 mmϕ at a charge ratio of 50%. The resulting mixture is dispersed for 2.5 hours by using a paint shaker, and a charge generating layer-forming solution is obtained as a result. The hydroxygallium phthalocyanine pigment content relative to the mixture of the hydroxygallium phthalocyanine pigment and the vinyl chloride-vinyl acetate copolymer resin is 55.0 vol %, and the solid content of the dispersion is 6.0 mass %. The content is calculated by assuming the specific gravity of the hydroxygallium phthalocyanine pigment as 1.606 $g/cm^3$, and the specific gravity of the vinyl chloride-vinyl acetate copolymer resin as 1.35 $g/cm^3$.

The obtained charge generating layer-forming solution is applied to the undercoat layer by dip-coating, and dried at 130° C. for 5 minutes to form a charge generating layer having a thickness of 0.20 μm.

Next, 8 parts by mass of a butadiene-based charge transporting material (CT1A) and 32 parts by mass of a benzidine-based charge transporting material (CT2A) serving as the charge transporting materials, 58 parts by mass of a bisphenol-Z polycarbonate resin (homopolymer-type polycarbonate resin of bisphenol Z, viscosity-average molecular weight: 40,000) serving as a binder resin, and 2 parts by mass (5 mass % relative to a total of 100 mass % of the charge transporting materials) a hindered phenol-based antioxidant (HP-1, molecular weight: 775) serving as an antioxidant are added to and dissolved in 340 parts by mass of tetrahydrofuran so as to obtain a charge transporting layer-forming solution.

The obtained charge transporting layer-forming solution is applied to the charge generating layer by dip-coating, and dried at 145° C. for 30 minutes to form a charge transporting layer having a thickness of 30 μm.

Photoreceptors are obtained through the steps described above. The following evaluations are conducted by using the obtained photoreceptors.

The specific details of the charge transporting materials and the antioxidant used in forming the charge transporting layers are as follows.

Butadiene-based charge transporting material: A compound (CT1A) represented by the structural formula below.

Benzidine-based charge transporting material: A compound (CT2A) represented by the structural formula below.

Hindered phenol-abased antioxidant: A compound (HP-1) represented by the structural formula below.

(CT1A)

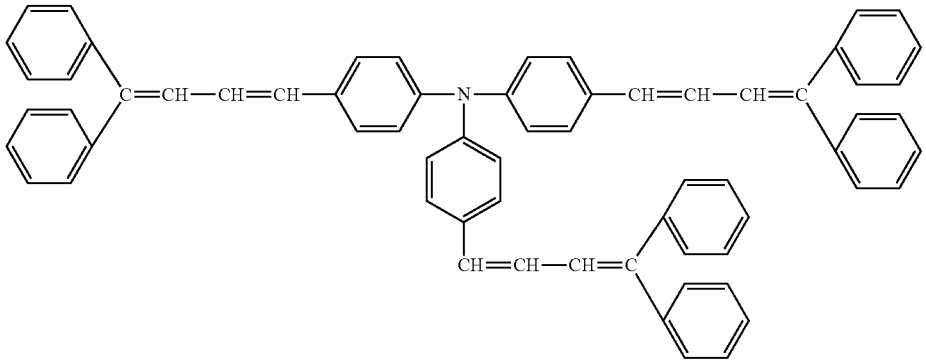

-continued (CT2A)

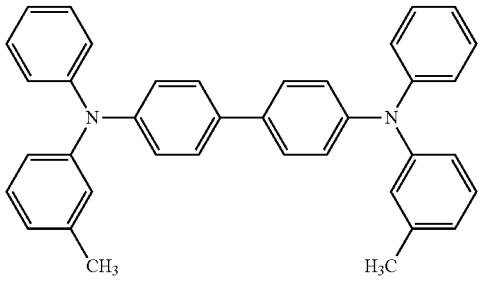

(HP-1)

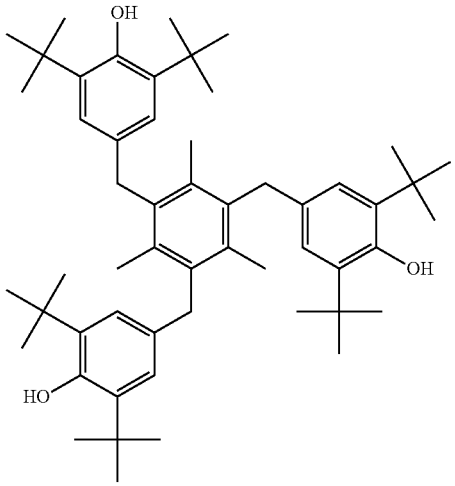

Image Quality Evaluation

The photoreceptor is attached to an image forming apparatus (DocuPrint C1100 produced by Fuji Xerox Co., Ltd.). A 50% halftone image is output by using this image forming apparatus by an image forming method that involves negatively charging the surface of the photoreceptor in an environment having a temperature of 20° C. and a humidity of 40% RH and forming an image with monochromatic light of 780 nm. Occurrence of white spots is evaluated from the obtained images. The results are indicated in Tables 1 and 2.

The evaluation standard is as indicated in Table 3. As for the details of the evaluation method, the spot defects (white spots) in the obtained image are classified into three sizes (areas), and the worst rating (the rating indicated by the largest number) among the ratings corresponding to the numbers of the spot defects of the respective sizes is used as the evaluation result. Specifically, for example, when there are eleven white spots smaller than 0.05 $mm^2$ in size, two white spots 0.05 $mm^2$ or larger but smaller than 0.1 $mm^2$ in size, and zero white spots 0.1 $mm^2$ or larger in size, the evaluation result is "7". The rating of 4 or less is practically acceptable.

TABLE 1

| | Impact press (IP) conditions | | | | | Properties of tubular body | | | | | |
|---|---|---|---|---|---|---|---|---|---|---|---|
| | Type of work performed on tubular body | Die radius mm | Maximum depth DA of groove mm | First distance L1 mm | Second distance L2 mm | Wall thickness mm | Thickness difference in bottom part mm | Surface roughness Rz2 | Surface roughness Rz1-Rz2 | Surface roughness Rz1/Rz2 | Vickers hardness HV2 |
| Example 1 | IP | 15 | 1 | 2 | 1 | 0.5 | 0.5 | 5 | 5 | 2 | 30 |
| Example 2 | IP | 15 | 0.8 | 2 | 1 | 0.5 | 2 | 0.01 | 39.99 | 4000 | 42 |
| Example 3 | IP | 15 | 0.5 | 2 | 1 | 0.5 | 1.3 | 2.5 | 19099 | 8.98 | 36 |
| Example 4 | IP/Ironing | 15 | 1 | 2 | 1 | 0.4 | 0.5 | 3 | 20 | 2 | 31 |
| Example 5 | IP/Ironing | 15 | 0.8 | 2 | 1 | 0.4 | 2 | 0.01 | 30 | 3000 | 45 |
| Example 6 | IP/Ironing | 15 | 0.5 | 2 | 1 | 0.4 | 1.3 | 1.5 | 25 | 16.67 | 38 |

| | Properties of tubular body | | | | | | | | |
|---|---|---|---|---|---|---|---|---|---|
| | Vickers hardness HV2-HV1 | Vickers hardness HV1/HV2 | Average crystal grain diameter (μm) D2 | Average crystal grain diameter (μm) D1-D2 | Average crystal grain diameter (μm) D1/D2 | In-plane evenness σRz | Thickness deviation | Evaluation Shock line | Evaluation Image defects |
| Example 1 | 5 | 0.83 | 50 | 950 | 20 | 3 | 5 | A | 1 |
| Example 2 | 27 | 0.56 | 0.1 | 99.9 | 1000 | 8 | 35 | C | 4 |
| Example 3 | 18 | 0.5 | 25 | 475 | 20 | 1 | 20 | B | 2 |
| Example 4 | 6 | 0.81 | 50 | 950 | 20 | 3 | 10 | A | 1 |
| Example 5 | 27 | 0.4 | 0.1 | 99.9 | 1000 | 8 | 29 | C | 4 |
| Example 6 | 15 | 0.61 | 25 | 475 | 20 | 2 | 18 | B | 2 |

TABLE 2

| | Impact press (IP) conditions | | | | | Properties of tubular body | | | | | |
|---|---|---|---|---|---|---|---|---|---|---|---|
| | Type of work performed on tubular body | Die radius mm | Maximum depth DA of groove mm | First distance L1 mm | Second distance L2 mm | Wall thickness mm | Thickness difference in bottom part mm | Surface roughness Rz2 | Surface roughness Rz1-Rz2 | Surface roughness Rz1/Rz2 | Vickers hardness HV2 |
| Comparative Example 1 | IP | 15 | 3 | 2 | 1 | 0.65 | 0.5 | 5 | 4 | 2 | 28 |
| Comparative Example 2 | IP | 15 | 0.2 | 2 | 1 | 0.65 | 2 | 0.01 | 41 | 4000 | 45 |
| Comparative Example 3 | IP/Ironing | 15 | 3 | 2 | 1 | 0.5 | 0.5 | 5 | 15 | 2 | 28 |
| Comparative Example 4 | IP/Ironing | 15 | 0.2 | 2 | 1 | 0.5 | 2 | 0.01 | 36 | 4000 | 47 |

| | Properties of tubular body | | | | | | | Evaluation | |
|---|---|---|---|---|---|---|---|---|---|
| | Vickers hardness HV2-HV1 | Vickers hardness HV1/HV2 | Average crystal grain diameter (μm) D2 | Average crystal grain diameter (μm) D1-D2 | Average crystal grain diameter (μm) D1/D2 | In-plane evenness σRz | Thickness deviation | Shock line | Image defects |
| Comparative Example 1 | 4 | 0.86 | 60 | 1140 | 20 | 9 | 1 | D | 5 |
| Comparative Example 2 | 38 | 0.15 | 0.05 | 49.95 | 1000 | 2 | 38 | E | 1 |
| Comparative Example 3 | 4 | 0.86 | 60 | 1140 | 20 | 9 | 1 | D | 5 |
| Comparative Example 4 | 38 | 019 | 0.05 | 49.95 | 1000 | 1 | 39 | E | 1 |

TABLE 3

| Evaluation standard | Level of white spots: Less than 0.05 $mm^2$ | Level of white spots: 0.05 $mm^2$ or more but less than 0.1 $mm^2$ | Level of white spots: 0.1 $mm^2$ or more |
|---|---|---|---|
| 1 | 0 | 0 | 0 |
| 2 | 1 | 1 | 0 |
| 3 | 2 | 1 | 0 |
| 4 | 3 | 1 | 0 |
| 5 | 4 or 5 | 1 | 0 |
| 6 | 6 or 7 | 1 | 1 |
| 7 | 8 or 9 | 2 | 2 |
| 8 | 10 or 11 | 3 | 3 |
| 9 | 12 or 13 | 4 | 4 |
| 10 | 14 or more | 5 or more | 5 or more |

The results indicate occurrence of a shock line and thickness deviation are suppressed in the circular tubular metal bodies of Examples compared to the circular tubular metal bodies of Comparative Examples.

The results also indicate that occurrence of white spots caused by the shock line is suppressed when the circular tubular metal bodies of Examples are used as the photoreceptors.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A tubular metal body comprising:

a tubular part having an opening at one end in an axis direction; and a bottom part disposed at another end of the tubular part in the axis direction, wherein a ratio (Rz1/Rz2) of a surface roughness Rz1 of an outer peripheral surface of the bottom part to a surface roughness Rz2 of an outer peripheral surface of a center portion of the tubular part in the axis direction is in a range of 2 or more and 4000 or less, a Vickers hardness HV1 of the outer peripheral surface of the bottom part is 5 HV or more and 27 HV or less smaller than a Vickers hardness HV2 of the outer peripheral surface of the center portion of the tubular part in the axis direction, and a ration (HV1/HV2) of the Vickers hardness HV1 of the outer peripheral surface of the bottom part to the Vickers hardness HV2 of the outer peripheral surface of the center portion of the tubular part in the axis direction is in a range of 18/45 or more and 25/30 or less.

2. The tubular metal body according to claim 1, wherein the Vickers hardness HV1 of the outer peripheral surface of the bottom part is 5 HV or more and 18 HV or less smaller than the Vickers hardness HV2 of the outer peripheral surface of the center portion of the tubular part in the axis direction.

3. The tubular metal body according to claim 1, wherein the ratio (Rz1/Rz2) of the surface roughness Rz1 of the outer peripheral surface of the bottom part to the surface roughness Rz2 of the outer peripheral surface of the center portion of the tubular part in the axis direction is in a range of 2.75 or more and 3800 or less.

4. The tubular metal body according to claim 1, wherein the surface roughness Rz1 of the outer peripheral surface of the bottom part is 5 μm or more and 39.99 μm or less larger than the surface roughness Rz2 of the outer peripheral surface of the center portion of the tubular part in the axis direction.

5. The tubular metal body according to claim 1, wherein an average crystal grain diameter D1 of the outer peripheral surface of the bottom part is 50 μm or more and 999.9 μm or less larger than an average crystal grain diameter D2 of the outer peripheral surface of the center portion of the tubular part in the axis direction.

6. The tubular metal body according to claim 5, wherein a ratio (D1/D2) of the average crystal grain diameter D1 of the outer peripheral surface of the bottom part to the average crystal grain diameter D2 of the outer peripheral surface of the center portion of the tubular part in the axis direction is in a range of 2 or more and 10000 or less.

7. The tubular metal body according to claim 5, wherein the ratio (Rz1/Rz2) of the surface roughness Rz1 of the outer peripheral surface of the bottom part to the surface roughness Rz2 of the outer peripheral surface of the center portion of the tubular part in the axis direction is in a range of 2.75 or more and 3800 or less.

8. The tubular metal body according to claim 5, wherein the surface roughness Rz1 of the outer peripheral surface of the bottom part is 5 μm or more and 39.99 μm or less larger than the surface roughness Rz2 of the outer peripheral surface of the center portion of the tubular part in the axis direction.

9. An el electrophotographic photoreceptor comprising:

a tubular metal body according to claim 1; and a photosensitive layer disposed on a surface of the tubular part of the tubular metal body.

10. The tubular metal body according to claim 1, wherein HV2 is within a range of 30 HV or more and 45 HV or less.

11. The tubular metal body according to claim 1, wherein Rz2 is within a range of 0.01 μm or more and 5 μm or less.

12. The tubular metal body according to claim 1, wherein Rz2 is within a range of 0.1 μm or more and 4 μm or less.

* * * * *